United States Patent [19]

Williams

[11] Patent Number: 4,516,536

[45] Date of Patent: May 14, 1985

[54] THREE CYCLE INTERNAL COMBUSTION ENGINE

[76] Inventor: Gerald J. Williams, R.R. #2, Nolalu, Ontario, Canada, P0T 2K0

[21] Appl. No.: 261,248

[22] Filed: May 6, 1981

[51] Int. Cl.[3] ..... F02B 75/00; F02B 75/26

[52] U.S. Cl. ..... 123/39; 125/58 AM; 125/79 A; 125/71 R

[58] Field of Search ..... 123/39, 79 A, 79 R, 123/190 E, 58 R, 58 A, 58 AB, 58 AM, 56 C, 71 R, 44 E, 43 C, 55 AA

[56] References Cited

U.S. PATENT DOCUMENTS

| | | | |
|---|---|---|---|
| 2,770,140 | 11/1956 | Palumbo | 123/58 AM |
| 2,966,899 | 1/1961 | Herrmann | 123/58 AB |
| 3,274,982 | 9/1966 | Noguchi et al. | 123/56 R |
| 3,456,630 | 7/1969 | Karlan | 123/58 AM |
| 3,623,463 | 11/1971 | De Vries | 123/193 P |
| 3,871,340 | 3/1975 | Zimmerman | 123/190 E |
| 4,090,478 | 5/1978 | Trimble et al. | 123/58 R |
| 4,149,498 | 4/1979 | Ferrell | 123/58 AA |
| 4,215,659 | 8/1980 | Lowther | 123/39 |
| 4,380,972 | 4/1983 | Parkins | 123/315 |

FOREIGN PATENT DOCUMENTS

| | | | |
|---|---|---|---|
| 847521 | 10/1939 | France | 123/79 A |

*Primary Examiner*—Craig R. Feinberg

[57] ABSTRACT

An axial piston type internal combustion engine of novel three cycle variety, wherein the complete combustion process within the combustion chamber consists of three distinct cycles, accomplished over two distinct strokes of each piston, the three cycles being: the high pressure charging cycle, the power cycle, and the postive total exhaust expulsion cycle. The aspiration is controlled by a rotary disc valve, while the fresh gas charge is pre-compressed to high pressure by a separate high pressure charger. The conventional intake stroke and compression stroke, normally directly or indirectly carried out by the power piston in conventional two stroke or four stroke engines, is entirely divorced from the functions of the power piston and its power train components. Intended to replace conventional engines when high specific output, high power to weight ratio, and economy of operation are paramount.

6 Claims, 16 Drawing Figures

F-F FIG. 9

THREE CYCLE INTERNAL COMBUSTION ENGINE

RELATED PATENT APPLICATIONS

1. Sleeve Valved Engine with Positive Total Exhaust Expulsion. Can. Application No. 368,052-5, U.S. application Ser. No. 225,039 now abandoned.
2. Entitled in Canada: Positive Total Exhaust Expulsion Internal Combustion Engine. Can Application No. 368,087-8 Entitled in U.S.: A Rotor Valved Engine with Positive Total Exhaust Expulsion. U.S. application Ser. No. 223,416 now abandoned.
3. A Reciprocating Plug Valve for Internal Combustion Engines. Can. Application No. 368,088-6.
4. A Drum Rotor Valved Axial Piston Engine. U.S. application Ser. No. 232,672, now abandoned.
5. A Radially Poppet Valved Axial Piston Engine. U.S. application Ser. No. 229,316, now abandoned.
6. A Radially Bucket Spool Valved Axial Piston Engine. U.S. application Ser. No. 232,671, now abandoned.
7. A Low Profile, Varying Stroke, Radial Cam Driven Engine. U.S. application Ser. No. 239,363, now abandoned.
8. A Rotary, Axial Piston, Internal combustion Engine. U.S. application Ser. No. 250,940, now abandoned.

FIELD OF THE INVENTION

This invention relates to piston type, positive displacement, internal combustion engines and more particularly to a novel three cycle combustion, using a separate high pressure charge pre-compressor.

BACKGROUND OF THE INVENTION

The background and main objects of the invention may perhaps best be understood by taking a typical automotive piston type internal combustion engine and modifying same hypothetically to obtain greater theoretical efficiency. Automotive engines are used with frequently varying power output for obvious reason, with the power output varied by admitting a varying weight of combustible gas charge to the combustion chamber. This is achieved by choking of or throttling, the gas charge intake. Let us assume that 75% of the usage time, automotive engines typically are used at 50% throttle. To improve the overall efficiency the intent is to obtain greater efficiency at this 50% throttle setting, since this 50% throttle setting represents by far the greatest usage factor.

First of all, the constant stroke of the typical engine is too long for the required intake of 50% gas charge weight; this wastes motion, and energy in the way of excessive friction, lost time and pumping losses, with the piston stroking longer than necessary against a vacuum. Secondly, the required 50% gas charge weight is not compressed to maximum permissible value. It is well known that for efficiency the gas charge must be compressed to maximum permissible value. Since the geometric compression ratio is fixed and determined by the gas compression ratio of 100% gas charge weight intake, the 50% intake is compressed to a volume which is roughtly 50% of the maximum permissible. So the first two hypothetical improvements to be made to the typical engine, are to provide an engine wherein the intake and compression strokes are reduced in length to 50%, while the power stroke is maintained at 100% length, and to raise the geometric compression ratio to the maximum permissible value for the new 50% gas charge weight intake, or roughly reduce the geometric volume of the combustion chamber at the end of compression stroke to 50% of the original volume. We have lost the original maximum power output potential of the hypothetical engine, but we have recuperated a substantial amount of this loss by less friction losses, less pumping losses, less wasted time, since the intake and compression stroke take only half as long, allowing more time for the expansion and exhaust strokes, and by fully compressing the 50% gas charge weight intake to maximum permissible value. The original engine, again having a fixed stroke length, probably did not expand the burning gas charge to full potential, even at 50% throttle setting, so we will improve on this by giving our hypothetical engine also an optimum expansion stroke. To overcome the problem of loss of maximum power output, we will introduce extra gearing in the transmission of our vehicle and our hypothetical engine will require a throttle setting on the average much closer to wide open.

The next hypothetical improvement to be made, is to drastically improve the usage factor for the highly stressed components of the engine.

It is known that for overall efficiency in positive displacement, piston type internal combustion engines, every aspect of engine operation, every function and every component must be optimized. Piston type engines utilize a cyclic combustion process and cyclic processes tend to have a weight penalty and power output penalty, since cyclic processes pass through a short duration power pulse followed by a re-charging cycle. The short duration power pulse places high peaking stresses on the components, making them relatively heavy, while the time wasted as required for re-charging is not conducive to high specific power output. Continuous combustion process engines, such as jet engines and rockets, therefore achieve uniform, continuous stressing of components, rather than short duration peak stressing, achieving lighter construction, while the continuous process, without cyclic stopping of the power output for cyclic re-charging, results in very high specific power outputs. In all transportation vehicles, the emphasis on weight reduction is becoming more important as the cost of fuels rises. Therefore, it is important to divorce light duty functions from components which are made to withstand heavy stresses. In conventional piston type engines, the complete combustion chamber, the valving means, and the power output components, the piston, connecting rod, crankshaft etc. are designed to withstand the peak combustion stresses, and it is inefficient to use these heavy duty components for light duty functions. In conventional four cycle engines, only the power output stroke utilizes the strength of the components, and eighty percent of the total time of operation is utilized for scavenging and re-charging the combustion chamber, to the time of ignition. Super charging these engines only increases the peak stresses and does not significantly alter the efficiency. Turbocharging eliminates the pumping losses of the piston whiel re-charging, and results in a much greater gas charge taken in, while also resulting in the piston delivering a little power during the intake stroke, as the gas charge is forced under pressure into the cylinder. These "boost" pressures are from five to thirty pounds per square inch, and the overall result of turbocharging therefore is an increase in efficiency, as well as an increase in specific output, the latter again, mainly at the cost of higher stressed components. The piston compression ratio is lowered but the overall compression ratio is approximately identical for these engines. Compound turbocharging, whereby some of the power output of the exhaust driven turbocharger is delivered to the crankshaft, is more efficient yet, but it is not practical for automotive use, since the high rotational inertia of the turbine is not readily switched on and off, to follow the continuously changing power demands of automotive engines. Raising the compression ratio extracts more energy from the fixed available energy in the gas charge, with some of the known reasons being: the closer proximity and higher agitation of oxygen molecules and fuel molecules resulting in stronger combustion; this stronger combustion acting in a smaller volume, resulting in higher pressures on the piston over its complete power stroke. In a typical engine, it is known that raising the compression ratio from 10.75 to 14.8 overall can raise the fuel economy by eight percent; but detonation becomes a serious problem at these higher ratios.

None of the measures so far discussed improve the utilization factor for the basic component parts involved. To achieve higher specific output, in two cycle engines, the exhaust stroke and the intake stroke are eliminated from the combustion chamber. The spent gases are spilled out of ports or valves at the bottom position of the piston, or forced out by pressurized air. Air or air and fuel is admitted to the combustion chamber while the piston is still generally in the bottom position, and the subsequent upstroke of the piston compresses this gas charge to the required value. Spent exhaust gasses are not positively and entirely removed, especially in smaller engines which depend on the dynamic, resonant characteristics of the expanding spent gas charge for scavenging, and some of the incoming fresh gas charge is lost with the exhausting spent gasses. Conventional four cycle engines are better in this respect but still do not usually employ a positive means of expelling all spent gasses either, since the final volume of the combustion chamber with the piston in the top position retains some spent gasses. Here also the dynamic resonant characteristics of the spent gas charge can be used to help extract more spent gasses, but again this is effective only over a very limited r.p.m. range. Conventional two cycle engines extract approximately twenty-five percent of the available energy of the fuel, while for conventional four cycle engines this figure becomes approximately thirty-three percent; an eight percent improvement over two cycle engines, indicating the importance of eliminating spent gasses. Exhaust gas remnants in the fresh gas charge deteriorate power and efficiency for two known reasons: many fuel molecules are shielded by exhaust gas molecules and cannot oxidize fully; exhaust gas remnants take up volume and the fresh charge is therefore not reduced in volume, or compressed, to maximum valve. Heat rejection through cooling fins and radiators etc., accounts for approximately thirty-three percent, while the energy lost with the exhaust gasses accounts for approximately the remaining thirty-three percent of the initial available energy. In conventional engines, the constant geometric engine displacements results in excessive pumping losses during average power demands, and if the volumetric displacement is varied by valve timing adjustments during operation, there still remains the wasted motion due to constant stroking of the intake and compression stroke. Adjusting power demand by choking off, or "throttling", the intake, results in significant power losses since it takes considerable energy to maintain a vacuum across a restricted opening. This background illustrates some of the areas wherein efficiency improvements are sought as objects of this invention and these may be summarized, as follows:

1. Reduce friction losses due to excessive bearing travel, waste motion and excessively large exposed friction areas.
2. Reduce pumping losses caused by throttling the intake to control engine output.
3. Reduce or eliminate engine intake vacuum.
4. Expel all exhaust gasses positively at all revolutions.
5. Recover some of the energy remaining in exhaust gasses by deep expansion.
6. Improve the utilization factor of all heavy, cyclically stressed components, from the present 20% in four cycles and from the present 33% in two cycles, without sacrificing fuel efficiency.
7. Eliminate duplicated components for each combustion chamber, especially the valve train, and separate crank throws.
8. Improve the output to weight ratio.
9. Improve the specific power output.
10. Reduce the envelope size.
11. Improve balance.
12. Control power output but a non-throttling means, yet maintain instant response to power demand.
13. Maintain or improve upon present longevity and ease of maintenance.
14. Remain within areas of established and known technologies.
15. Control power output with a constant geometric volume combustion chamber, constant valving timing, but variable final charge weight and pressure, this being identical to the power control in conventional engines. A variable geometric volume, variable charge weight, but constant charge pressure power control method, is the object of a different U.S. patent application by the inventor.

SUMMARY OF THE INVENTION

The present invention provides an engine arrangement which claims to meet the sought after efficiency improvements as listed in the previous Background of the Invention. An inwardly opposed axial piston, axial cam driven, engine, with aspiration controlled by a single centrol rotary disc valve, axially ported, achieves positive total expulsion of spent gasses, by virtue of reducing the combustion chamber to zero volume in the top dead center position of the piston at the end of the exhaust cycle. The engine so far disclosed, is covered by a U.S. patent application Ser. No. 223,416. The conventional intake stroke and compression stroke are eliminated from the combustion chamber and from the functions to be performed by the power pistons. Starting from zero volume at the end of the exhaust cycle, the combustion chamber is increased in volume and charged with a pre-compressed high pressure gas charge during the initial downward movement of the piston, till a point is reached where normal ignition takes place. At this point, the high pressure charging port is closed, and ignition initiated. The power stroke may be extra long, relative to the gas charge received by the combustion chamber; the piston movement is controlled by an axial cam, allowing variation in piston travel; the extra long power stroke would utilize more of the energy in the expending charge. From the bottom dead center position, the piston is driven completely upward into the combustion chamber, positively and totally expelling all spent exhaust gasses through an exhaust port in the rotary disc valve. The complete combustion cycle within each combustion chamber thus consists of three distinct parts or cycles, namely, the high pressure charging cycle, the power cycle, and the positive total exhaust expulsion cycle, accomplished over two piston strokes. This is distinct and different from conventional two cycle engines, in which exhausting and charging takes place in a non-positive manner in the bottom dead center piston position and in which the piston upstroke compresses the fresh gas charge to final pressure. In this invention the piston upstroke is not used for compression but exclusively for exhaust expulsion. The advantages of this invention are a utilization factor of approximately 40 to 42½% for the heavy power train and combustion chamber components with an increase in fuel economy due to a lack of contamination of the fresh gas charge, and optimum deep expansion during the power stroke in the 75% to 100% power output range. Conventional four cycle engines usually have a utilization factor of approximately 20% and suffer from some fresh gas charge contamination, while conventional two cycle engines have an utilization factor of approximately 33%, but suffer from serious fresh gas charge contamination. The fresh gas charge is precompressed by a variable stroke, axial cam driven piston type high pressure charger, while the high pressure charge is delivered to the rotary disc valve for distribution to the cylinders via a hollow main shaft. The overall effect of divorcing the intake and compression function from the power pistons is a very advantageous weight and size trade-off namely; for the extra weight and complexity of the high pressure charger the effective power of the engine is doubled, without doubling the intensity of peak stresses encountered by the power train components etc. The engine is thus effectively doubled in "size" or, alternatively, is significantly lighter in weight and much smaller in envelope size. In a normal engine, the pistons, piston rods, crankshaft etc. are designed to withstand piston pressures of 1000 to 1500 lbs. p.s.i., but are utilized 80% of operating time under piston pressures of a maximum of 150 to 200 lbs. p.s.i. The fresh gas intake and compression function therefore is advantageously handled by a high pressure charger designed for 150 to 200 lbs. p.s.i. service.

Another object of the invention is to eliminate excessive pumping losses in conventional practice caused by fixed geometric volume stroking of pistons during the intake and compression stroke and throttling gas charge intake, to control power output. The object here is to control power output by displacing the intake device no more than required by the power demand and by eliminating a power robbing throttle entirely. Engine power output is varied by adjusting the displacement of the high pressure charger, while a commercially available electronically monitored fuel injection system supplies the exact amount of fuel according to air taken in by the high pressure charger and according to engine load conditions, and power demand. A throttle in the intake duct is thus not needed and the associated throttling losses are eliminated. The high pressure charger is of variable displacement.

To ensure instant throttle response as required in automotive engines under certain conditions, two modes of operation are provided. In mode one, the instant power mode, a pressure sensor and related control maintain a certain pressure value for the high pressure gas charge contained within the hollow main shaft, in a pressure range which may be adjusted to suit, and this could be from 80 to 200 lbs. p.s.i., depending on permissible value for the fuel used. The flow of the high pressure gas charge from this reserve reservoir to the rotor valve is controlled by an axially operated spool valve contained within the rotor valve. The high pressure charger output in this mode is controlled by the pressure sensor, while engine power output is varied by adjusting the spool valve. In mode two, the cruising and economy mode, the slight time lag of a couple of seconds caused by the volume of the reserve reservoir, is acceptable and engine power output is varied by adjusting the displacement of the high pressure charger, with the spool valve wide open.

Six alternative ignition means are provided: 1. Conventionally arranged spark plugs; 2. a small pre-combustion, jet ignition chamber in each combustion chamber, pre-flushed with a fresh gas charge; 3. a small pre-combustion, jet ignition rich mix chamber in each cylinder pre-flushed with an extra rich fresh gas charge supplied by a separate rich mix pre-compressor, not shown; 4. a rotating chain reaction ignition chamber; 5. a centrifugally governed ignition system, which is self-sustaining, and controlled plunger; 6. a rotating special spark ignition means.

The novel cycle, as disclosed, may be applied to most positive displacement engines wherein it is possible to achieve the required sequence in the combustion chamber, the sequence being:

1. Drive the piston tightly into the combustion chamber, reducing it to zero or very small volume.
2. Close the exhaust valving means.
3. Open the high pressure intake valving means.
4. Increase the combustion chamber volume slightly by lowering the displacer, the "piston".

Sequence 1 and 4 are not strictly required; a cam driven engine may have the piston standing still momentarily, while the high pressure charge is admitted; however, following sequence 1 and 4 is an advantage for a crank-driven engine since it gives the time required for charging, and it results in the "proper" geometric volume of the combustion chamber at the end of the high pressure charging cycle.

5. Close the high pressure intake valving means and ignite the charge.

The preferred embodiment of this invention as illustrated in the drawings is particularly suited for this novel cycle since it has sharp, positive valving action, and since the high pressure charging port is nearly the full width of the wide open or nearly wide open cylinder bore, with the high pressure charging port travelling transversely across this wide open cylinder bore, placing a layer of high pressure gas charge across the top of the piston. The preferred embodiment is illustrated in two versions; number one version with one power stroke per piston per revolution and nunber two with two power strokes per piston per revolution. The preferred embodiment is of such nature that it can be made with any practical number of power strokes per piston per revolution. Maintaining the same piston diameter, the same stroke and the same piston speed, will result in slower and slower revolutions of the engine as more and more piston and power strokes per piston per revolution are added, yet the critical criteria, such as rubbing velocities for the rotary disc valve, and balance will not increase or be affected.

These and other features and advantages of the invention will be more fully understood from the following description of certain preferred embodiments taken together with the accompanying drawings.

BRIEF DESCRIPTION OF THE DRAWINGS

In the drawings: all numerals are consistent for identical components.

DESCRIPTION OF THE ILLUSTRATED EMBODIMENT

Figure 1:
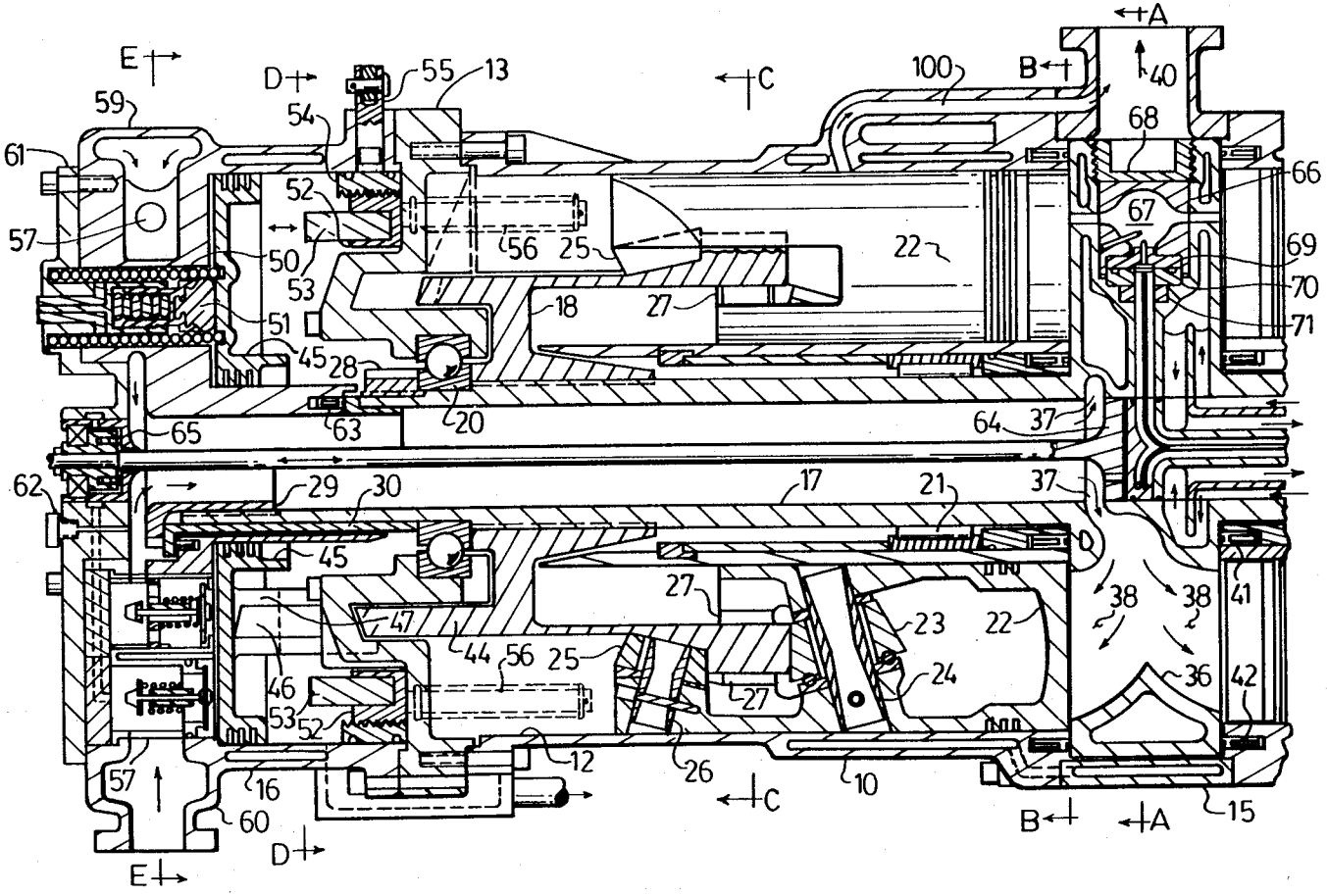
FIGS. 1 and 1A are longitudinal cross sections of the preferred embodiment of the invention, showing the pertinent parts of the axial piston, axial cam driven engine; the rotary disc valve; one of the alternative ignition means; the high pressure charger; and the ancillary systems; all formed according to the invention, and designated as Version 2 (with the ignition means shown out-of-time for illustrative purposes only).
Figure 1A:
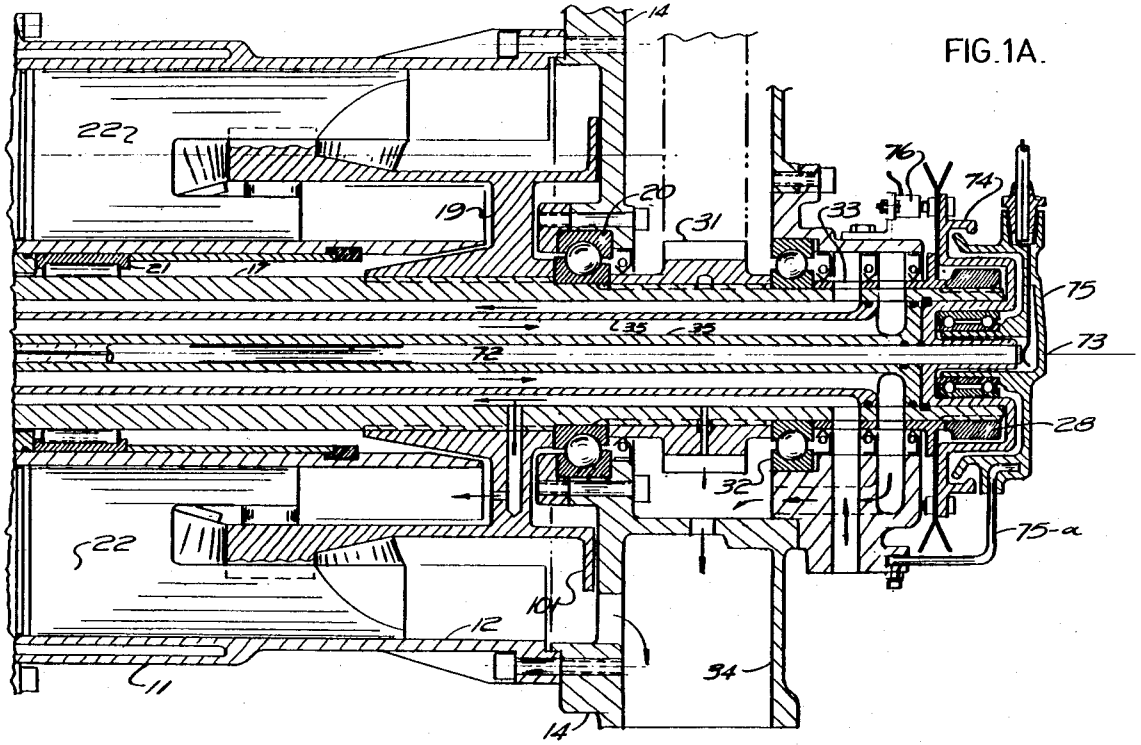

Referring first to FIGS. 1 and 1A of the drawing there is shown an internal combustion engine of the axial piston, axial cam type, formed according to the invention. Numerals 10 and 11 each represent an axially opposing cylinder block, with a number of cylinders, 12, in each cylinder block arranged annularly and in parallel symmetrically around the long, common axis of the engine. All cylinders 12 in one cylinder block are axially in line with opposing cylinders in the other cylinder block. The intake side cylinder block 10 terminates in an intake side end cover 13, while the output side cylinder block terminates in an output side end cover 14. Both cylinder blocks 10 and 11, are joined and held in rigid concentric axial alignment by a rotary disc valve housing 15. Intake side cylinder block 10 has mounted on it high pressure charger cylinder 16 which is axially inline with, and concentric with, the long axis of the engine. A hollow main shaft 17 is carried rotatably by main bearings 20, on the long axis of the engine and has mounted on it an axially profiled intake end axial cam, 18, and an identically but oppositely axially profiled output end axial cam 19. Additional internal steady bearings 21, support the hollow main shaft 17. Power pistons 22 reciprocatably disposed in cylinders 12 are operatively connected to the axial cams 18 and 19, by means of a main cam roller 23 which is rotatably supported on a main cam roller pin 24, and further by means of a cam follower roller 25 which in turn is rotatably supported on a cam follower roller pin 26. The illustrated embodiment of power pistons 22 being one piece construction, incorporating tapered rollers on inclined pins and also incorporating piston anti-rotation means by closely straddling the cylindrical surface of axial cams 18 and 19 is covered by a separate U.S. patent application Ser. No. 250,940, entitled "A Rotary, Axial Piston, Internal Combustion Engine", now abandoned.

Power pistons, 22 are slotted and straddle the profile on the axial cams 18, 19. To maintain proper contact with the profile on the axial cam 18 and 19, the power pistons 22 are prevented from any rotation in the cylinders 12 by means of piston-anti-rotation pads 27 which bear closely against the cylindrical inside and outside surfaces of the axial cams 18 and 19. The piston-anti-rotation means, a one piece, slotted piston, straddling and bearing closely against the inside and/or outside cylindrical surfaces of an axial cam, and which piston may or may not be provided with separate piston anti-rotation pads, as shown, is covered by U.S. patent application, Ser. No. 250,940 now abandoned, and entitled: "A Rotary, Axial Piston, Internal Combustion Engine".

The cylinders 12 are slotted in the bottom portion of the bores to straddle and clear the axial profile on the axial cams 18 and 19. Main bearings 20 are retained on the hollow main shaft 17, by main bearing retaining nuts 28. An alternative means of retaining the intake end main bearing is alternative main bearing retaining nut 29, used together with alternative main bearing retaining sleeve 30. Power take-off is by means of a power output sprocket or gear 31, with additional support provided by front steady bearing 32. Output side main bearing 20 and front steady bearing 32 are retained in place on the hollow main shaft 17 by bearing retaining sleeve 33. Engine lubricating and cooling oil is gravity fed to an oil return tunnel 34, which leads to the sump. From the sump, oil is pressure fed by an oil pump, not shown, to concentric oil distributors 35, carried within the output side half of hollow main shaft 17. Some of this oil is fed to the interior of a rotary disc valve 36, for cooling purposes. Arrows in FIG. 1 show the proposed oil flows. The rotary disc valve 36 is securely carried by, and rotably locked to, the hollow main shaft 17. Rotary disc valve 36 completely covers the opposing ends of the cylinder blocks 10 and 11, and thereby forms combustion chambers in the tops of cylinders 12. The engine so far disclosed is covered by U.S. patent application Ser. No. 223,416 now abandoned and entitled: "A Rotor Valved Engine with Positive Total Exhaust Expulsion".

Figure 7:
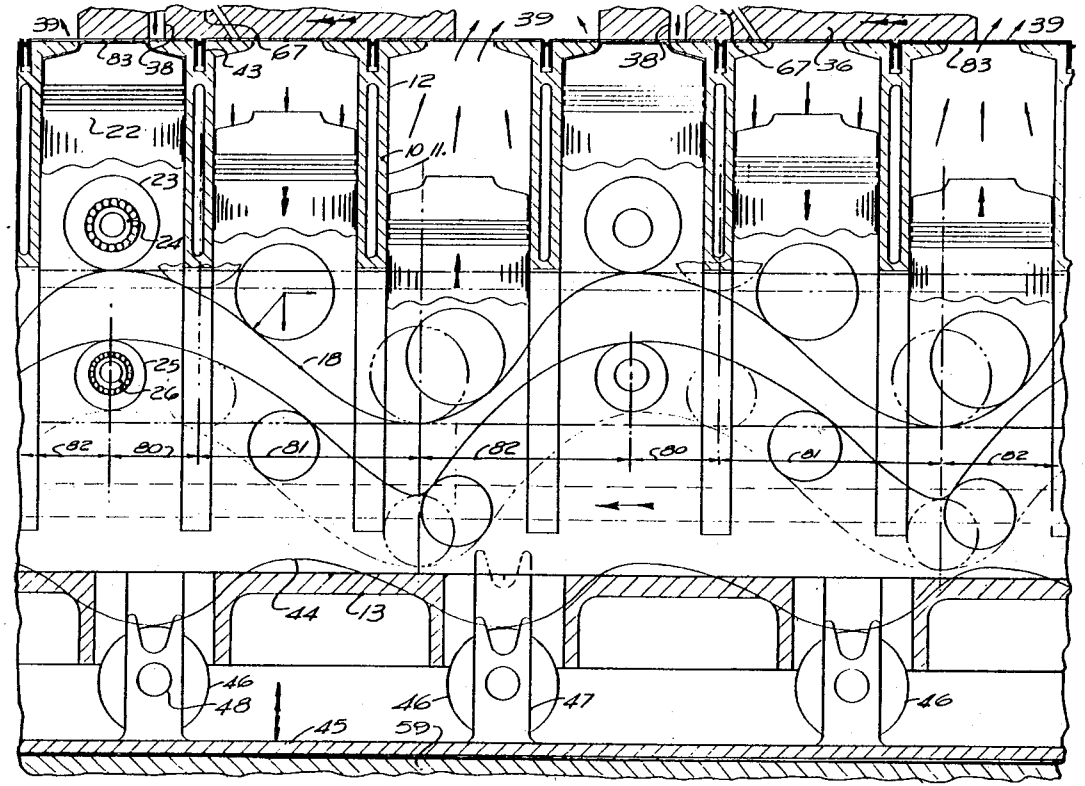
FIG. 7 is an annular cross section of a cylinder block taken on the long centerline of the cylinders and laid out on a flat plane, and showing relationships between power pistons, rotary disc valve ports, axial cam profile; high pressure charger cam profile and high pressure charger piston for Version 2.
Figure 10:
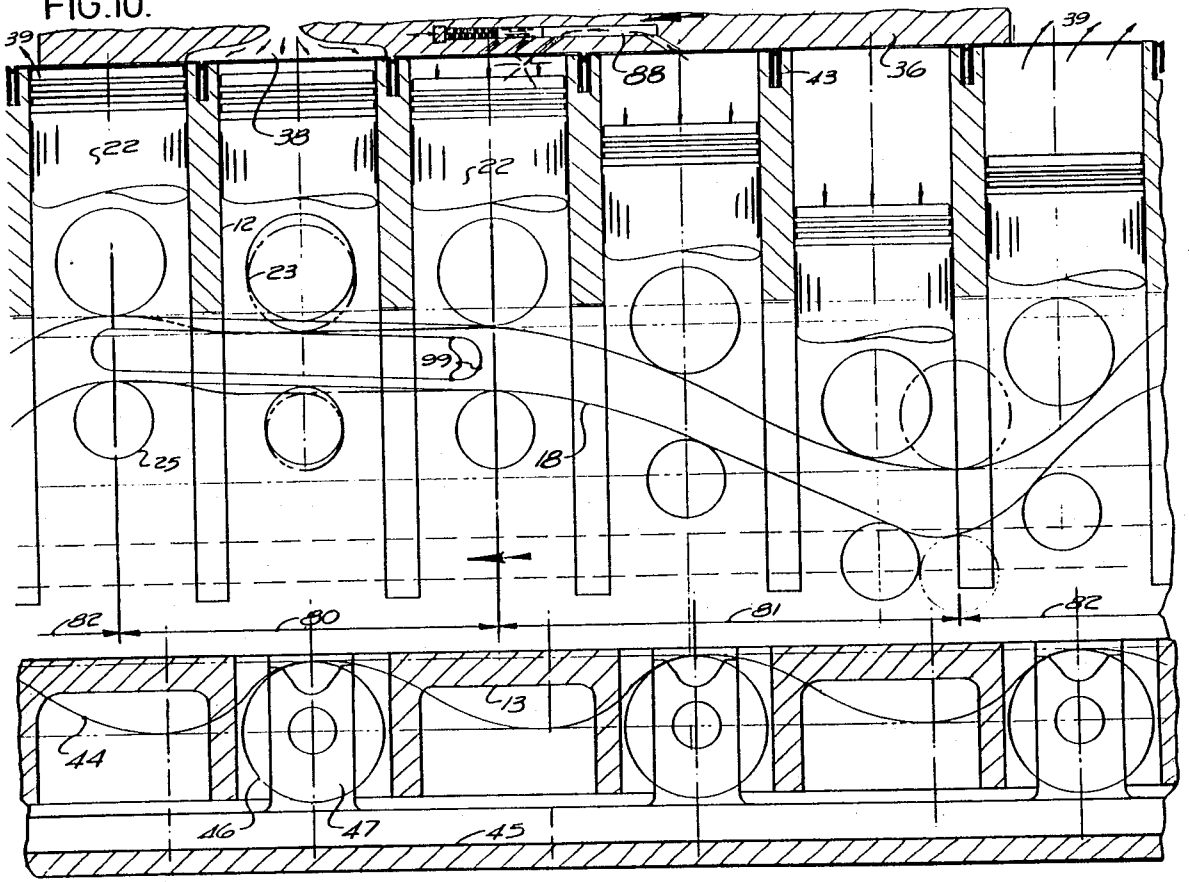
FIG. 10 is an annular cross section of the cylinder block taken on the long centerline of the cylinders and laid out on a flat plane, showing relationships between power pistons, rotary disc valve ports, axial cam profile, high pressure charger cam profile, and high pressure charger piston for Version 1.

The rotary disc valve 36 is provided with high pressure charging ports 38, which establish communication between the cylinders which are ready to receive a fresh gas charge, and the high pressure charger cylinder 16, the communication route following a high pressure charge spool port 37, the hollow interior of the intake side half of hollow support shaft 17 and high pressure charger outlet valve 58. The rotary disc valve 36 is further provided with exhaust ports 39, which establish communication between those cylinders which are ready to exhaust their spent gas charge and the atmosphere, the communication route following the interior of rotary disc valve housing 15 and exhaust duct 40. The said ports 38 and 40 are brought into axial alignment with the axially opposing cylinders in perfect synchronization and in timed relation with the position of the power pistons 22, by rotating in step with the sprofile on the axial cams 18 and 19. Combustion chambers are sealed by rotary disc valve inner seal 41, rotary disc valve outer seal 42, and cylinder separation seals 43. These seals are all axially acting face seals, bearing and sealing against the parallel flat faces of rotary disc valve 36. These seals also seal in the high pressure gas charge and allow it to flow only into those cylinders which are ready to receive a high pressure gas charge. The outward end of the intake side axial cam 18, is provided with a concentric axial cam, axially profiled outwardly high pressure charger cam 44. High pressure charger piston 45 is reciprocatably disposed in high pressure charger cylinder 16, said piston comprising a large diameter annular disc, with a hole in the center, and provided with piston rings around the outside and inside diameters, and further provided with bifurcated high pressure charger roller legs 47 on the bottom. Said legs 47 straddle the profile on the high pressure charger cam 44, and carry a high pressure charger roller 46 on a high pressure charger roller pin 48. The high pressure charger piston 45 is axially biased towards the profile on the high pressure charger cam 44, by a number of high pressure charger piston return springs 50, carried in the high pressure charger valve head 59. High pressure charger rollers 46, may be provided with shock absorbing elastic inserts 49, or alternatively high pressure charger cam 44 may be separated from axial cam 18, with an elastic cushion installed between and bonded to both. The purpose of elastic cushions in this application is to reduce shock and noise. It should be noted that whenever high pressure charger piston 45 is not allowed a full stroke, rollers 47 land on the inclining slopes of the profile resulting in impact and noise; however, at the instant of landing, there is no pressure in the high pressure charger cylinder, but there is a slight vacuum instead; thus at the instant of impact only the inertia of the reciprocating parts need be overcome. As shown in FIGS. 7 and 10, the profile on high pressure charger cam 44 is executed to allow a rapid return of charger piston 45 and a shallow inclining slope, resulting in minimum acceleration stresses on the moment of impact. Elastic cushions as described will eliminate shock loads. Upward travel of the high pressure charger piston 45, is restrained by springs 50 and in top dead center, the high pressure charger piston 45 is prevented from hitting the inside of valve head 59, by topping out on top bumpers 51. These top bumpers 51 are adjustable and comprise a reinforced hard and tough elastomer bumper, locked in a metal cylinder, which is allowed to deflect slightly and is cushioned by a number of elastic annular inserts, all arranged in a compact, integrally contained cartridge, which may be adjusted via a threaded end stud so that all top bumpers 51 contact the top of the high pressure charger piston 45 simultaneously. Piston 45, has an adjustable stroke. In its downward travel it is intercepted by bottom stopper insert 53, comprising a cylindrical elastomer ring, and carried in an annular metal support ring, U-shaped in cross section, and designated as high pressure charger bottom stopper 52. Bottom stopper 52 is prevented from rotating by bottom stopper axial locators 56, which either comprise rods, passing through intake side end cover 13, or which may comprise axial splines machined in intake side end cover 13, and shown in FIG. 8. Bottom stopper 52 is provided with coarse or Acme threads on its outside cylindrical surface, said thread being of multiple start, with a pitch of one in four. Said thread engages a matching female thread in high pressure charger adjuster 54, said adjuster defining a cylindrical ring, rotatably installed in the bottom end of the high pressure charger cylinder bore; and prevented from axial movement by a large snap-ring. Through a radial slot in the attachment flange of high pressure charger cylinder 16, an adjuster control quadrant 55, engages and is fastened to the outside cylindrical surface of adjuster 54. A semi-circular movement of control quadrant 55, axially displaces bottom stopper 52, and thereby adjusts the stroke of high pressure charger piston 45, from full stroke to minimum stroke. The stroke length of high pressure charger piston 45 determines the volume of the fresh gas charge delivered to the combustion chambers and therefore controls the power output. The effect is identical to the throttling effect commonly used to control power output, and this control effect is achieved in this invention with no wasted motion. Controlling engine output by adjusting the stroke of the high pressure charger piston is designated as the "Economy Mode", since energy losses occur across the spool valve and therefore the spool valve should be wide open for economy mode.

Figure 6:
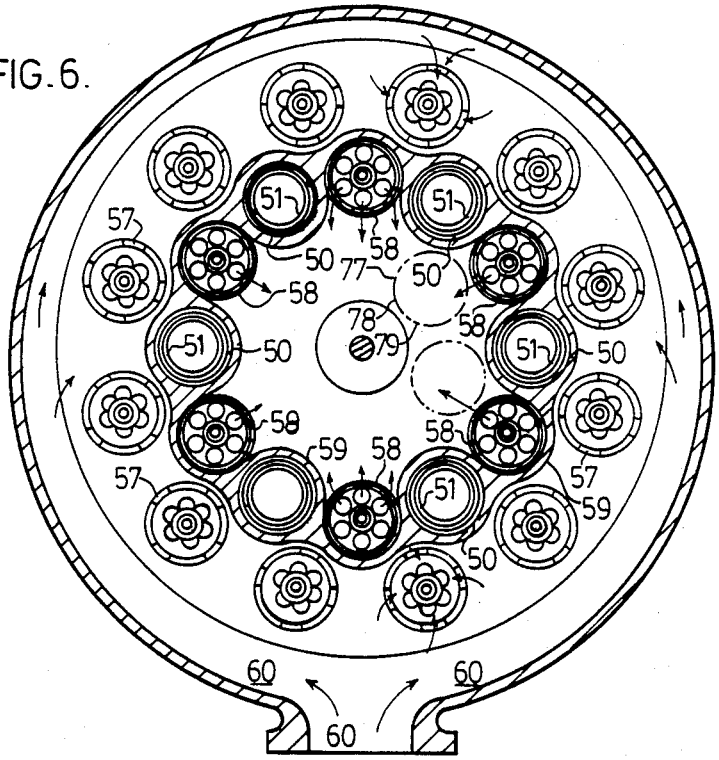
FIG. 6 is a transverse cross section of the engine showing the high pressure charger valving means and taken on plane E—E in FIG. 1.

Since the volume of the interior of the hollow main shaft 17, will result in a lagging "throttle response", a second "instant response" control mode is provided for. In this second mode, control quadrant 55 is operated by a power device which is controlled by a high pressure charger pressure sensor 62. This sensor 62, senses the pressure of the high pressure charge, and maintains the pressure in the interior of the hollow main shaft 17 at a pre-set value, possibly in a range from 80 to 200 lbs. p.s.i., by adjusting the stroke of the high pressure charger piston. In this mode, engine power output is controlled by a spool valve 64, which controls the flow of high pressure charge into the combustion chambers. Pressure on both ends of this valve is approximately equal by means of an equalizing hole, but a slight bias towards the closing position is the result of slightly unequal areas on both ends of the spool valve 64, and which is a favourable condition, from a safety viewpoint. Loss of high pressure charge gasses is prevented by a rotary spool valve gland 65, which allows rotation and axial displacement of the control rod for spool valve 64. A long life and dependable face seal is incorporated in the spool valve gland cartridge 65, and any gasses escaping past the seals on both the inside and outside of said cartridge is routed back to the high pressure charger inlet duct 60, as clearly shown on the drawings. Any high pressure charge gasses escaping past high pressure charger bottom seal 63, are routed back to inlet duct 60, via the engine's positive "crankcase" ventilation system. The high pressure charger valving means comprises self-acting inlet valves 57, and outlet valves 58. These valves are designed for continuous 200 p.s.i. service, are low inertia, spring biased, stemmed disc type. A great number, dispersed over the entire top area of the high pressure charger piston ensures easy breathing. In addition, the high pressure charger valve head 59, also supports a number of backfire relief valves, 77, 78 and 79 combined. Any combustion in the interior of the hollow main shaft 17 is relieved to atmosphere by means of these safety-type valves. See FIG. 6 for the location of these valves. An inlet duct 60, communicates with electronically monitored precision fuel injection equipment, commercially available, and the engines air filter. A valve head cover 61, allows ready servicing of the inlet and outlet valves 57 and 58.

The ignition of the high pressure charge in the combustion chamber is handled by one of several alternative means. In FIG. 1, a "Chain reaction" ignition cartridge 66 is shown as carried by the rotary disc valve 36. To start the engine an extra rich mixture is provided, which finds its way into the chain reaction chamber 67 by means of lateral orifices, communicating with those cylinders ready for ignition. A high voltage spark is provided by integrated electrodes, of which the center supply electrode is insulated by ceramic insert 69. Reaction chamber 67 is provided with an insulated coating, preventing heat loss and it thus forms a "radiating cavity". The center supply electrode terminates in a flush button on the outside surface of the ceramic inserts. The cartridge 66 is retained by cartridge retaining nut 68, and is serviced via a radial opening, suitably covered, in rotary disc valve housing 15. Concentrically carried, laterally branching, electrical conductor, high tension lead 72, terminates at each ignition cartridge 66 in a termination ceramic insulator 70, provided with a precision ground flat end face which accurately matches the precision ground similar end face on the ignition cartridge 66. An O-ring seals out moisture and prevents voltage leakage. Further protection is provided by elastic insulator 71. High voltage lead 72, terminates outwardly in a rotary high tension connector 73. This device is precision molded from high strength insulating material and comprises a rotary insulator 74, and a stationary insulator 75. A ball bearing cartridge insures precision radial alignment, while matching rims around the outside provide a labyrinth type seal, with centrifugal force continuously throwing out dirt and moisture, and with the conical flange on the stationary insulator 75, preventing water droplets from entering. A stay brace 75-a, prevents stationary insulator 75, from rotating and axially locks same in position. The ignition signal is generated by signal generator 76, as part of a modern electronic ignition system, commercially available. The "chain reaction" ignition cartridge provides ignition as follows: after the initial firing, an extremely high pressure, extremely hot gas charge, is carried by chain reaction chamber 67, to the next adjacent combustion chambers, which are charged with a fresh charge. In this engine, cylinders fire in sequence. The hot, extremely high pressure gas charge, rushes from chain reaction chamber 67 into the fresh gas charge, and ignites same. This results in a renewed, extremely high pressure, extremely hot gas rushing back into chain reaction chamber 67, and this renewed hot charge is carried to the next adjacent combustion chamber. A resonant outward and inward rushing hot gas pulsating rhythm is established and maintained. The action is similar to the chain-reaction which took place in the German V-1 Buzz Bomb, or otherwise known as the Argus pulse jet engine. The disadvantage of this simple system is that a single misfiring kills the chain reaction, and that timing is fixed.

Figure 9:
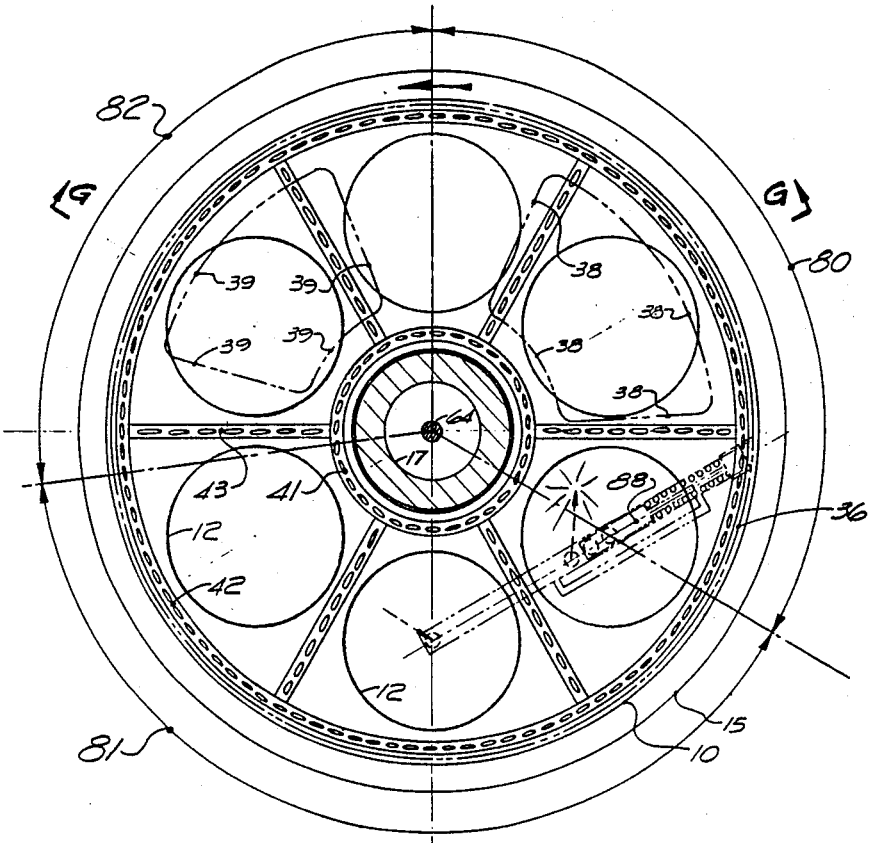
FIG. 9 is a transverse cross section of the engine showing the top of the cylinder block, the sealing means, the relationship between the cylinder bores and the ports in the rotary disc valve, the self-sustaining ignition means and taken on plane F—F in FIG. 8.

The second alternative ignition means is illustrated in FIGS. 9 and 10. It comprises a self-sustaining, centrifugal governor controlled ignition system. Referring to FIG. 9, numeral 88 indicates a bored hole, in rotary disc valve 36, on a plane parallel with the end faces of said disc valve, and oriented, from the perimeter, inwardly, to terminate above the cylinders in the process of combustion. A small inlet opening communicates with the said cylinders. The bored hole further passes across the leading, adjacent cylinders, ready for ignition, and a series of small exit orifices communicate with said leading adjacent cylinders. A plunger is reciprocatably disposed in said bored hole and blocks the said exit orifices. The said plunger is biased towards the center of rotation by a coil spring while a plug disposed of the outward end retains same. Centrifugal force acting on said plunger will counteract the biasing action of said coil spring and as the engine speed increases the leading exit orifices will gradually and sequentially be exposed. Hot gasses will rush from the succeeding cylinder into the preceding cylinder, igniting same, the preceding cylinder being the leading cylinder from a viewpoint of the rotation of the rotary disc valve. A balancing duct maintains equal pressure on both ends of the plunger and prevents combustion pressures from affecting the advancing and retarding action.

Figure 2:
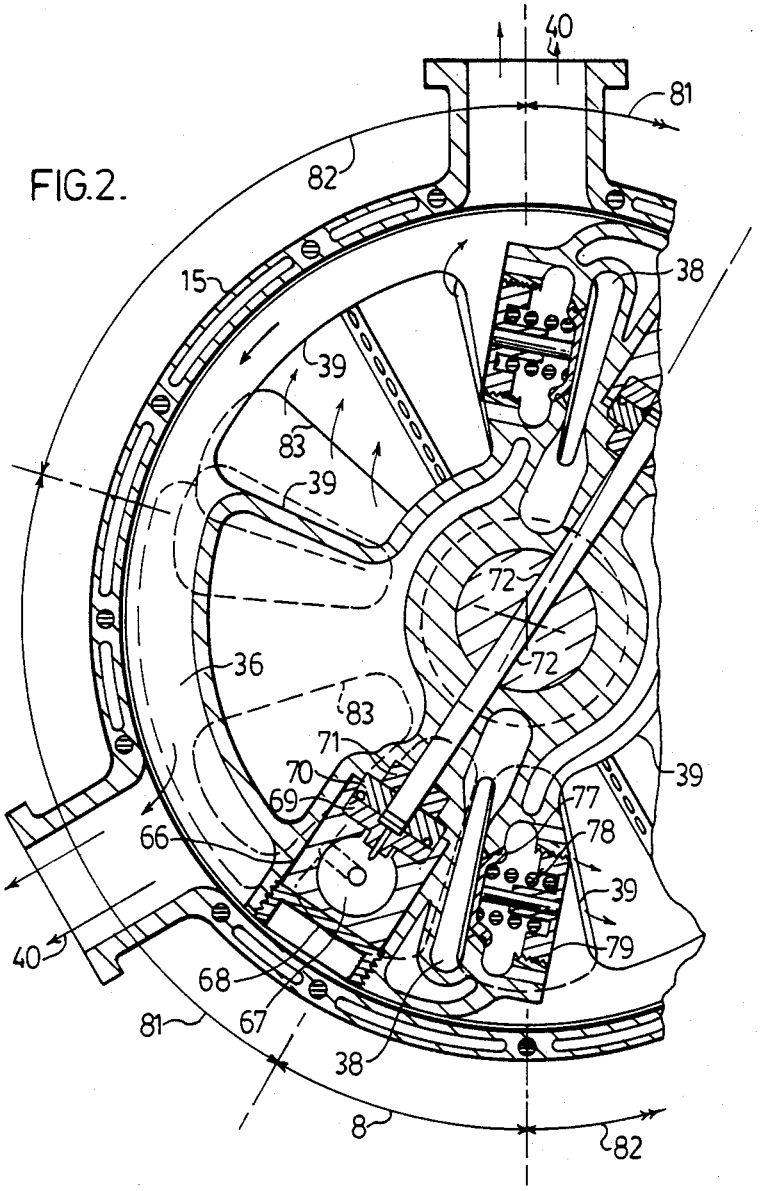
FIG. 2 is a transverse cross section of the rotary disc valve arrangement, showing one of the alternative ignition means, port relationships, backfire relief valve, rotary disc valve housing, and taken on plane A—A in FIG. 1.
Figure 13:
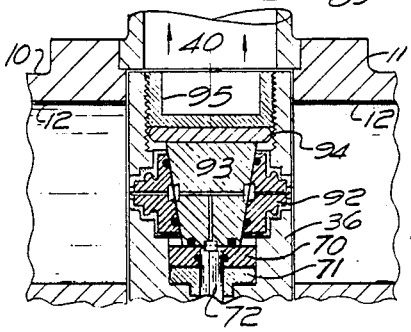
FIG. 13 is a cross section of one of the alternative ignition means and taken on the longitudinal centerplane of the engine.

The third alternative ignition means is illustrated in FIG. 13. This means again is mounted in the rotary disc valve. Chain reaction ignition cartridge 66, as shown in FIGS. 1 and 2, is replaced by special drop-in spark plugs 92 tapered spark plug retainer 93, elastic disc 94, and special spark plug retaining nut 95. Special drop-in spark plugs 92, are extremely shallow, cylindrical, stepped pyramids, matching stepped bored holes in the rotary disc valve 36. The bottom surface of spark plug 92, is a few thousandths of an inch above the flat end face of the rotary disc valve 36. The top surface of special drop-in spark plugs 92, are tapered and precision ground, while the exposed top surface is mainly insulating ceramic. The perimeter of the top surface is provided with an O-ring groove. Tapered spark plug retainer, 93, is a precision ground, ceramic block-shaped to have one pair of parallel sides, one pair of parallel ends and with a tapered top and bottom surface. It is thus a truncated wedge. The center electrode of spark plug 92 terminates in a flush metal button on the center of the slanted top surface. Mating flush buttons are incorporated in the tapered sides of tapered spark plug retainer 93, while an additional flush button is located in the center of the flat parallel top surface. Latter button is surrounded by an O-ring groove. The three metal buttons in retainer 93 are electrically interconnected. Dimensionally the component parts of the third alternative ignition means illustrated in FIG. 13 are arranged so that tightening of the special spark plug retainer nut 95, will seat the special drop-in spark plugs 92, compress the three O-rings, and deflect high tension termination ceramic insert 70, and make flush contact between each of the three pairs of metal contact buttons. Elastic disc 94 prevents excessive tightening pressure from cracking the ceramic components, while high tension termination elastic insulator 71, allows slight deflection of termination ceramic insert 70. The overall cavity in rotary disc valve 36 required to accommodate the components allows the special drop-in spark plugs 92 to protrude slightly into the interior of said cavity which facilitates servicing. The third alternative ignition means achieves central ignition of the fresh gas charge and may be electrically advanced or retarded; advancing or retarding will bring the electrical spark slightly off-center relative to the cylinders being served, as this ignition means travels with the rotary disc valve from cylinder to cylinder.

Figure 3:
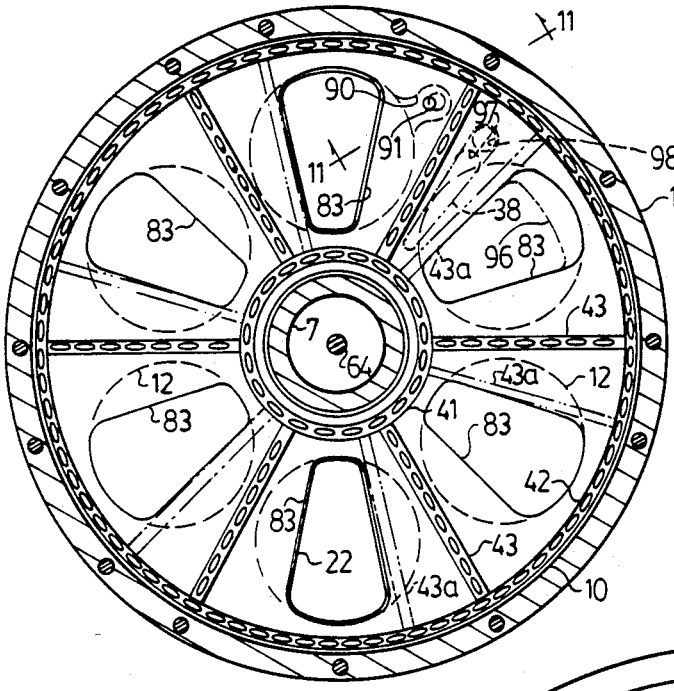
FIG. 3 is a transverse cross section of the engine showing the top of the cylinder block, the sealing means, constricted cylinder bore port openings, relationship of high pressure charging port and jet ignition chamber, and taken on plane B—B in FIG. 1.
Figure 4:
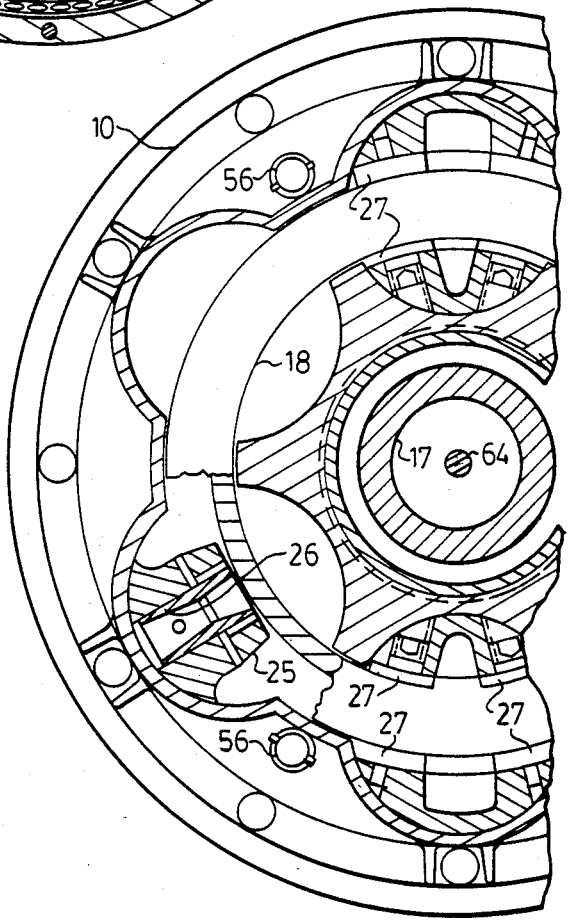
FIG. 4 is a transverse cross section of the cylinder block showing the axial cam, axial cam clearance slot, piston anti-rotation means, cam follower roller, and taken on plane C—C in FIG. 1.
Figure 12:
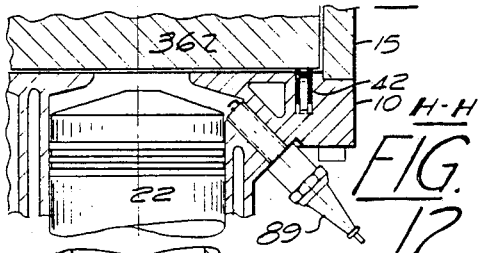
FIG. 12 is a cross section of one of the alternative ignition means and taken on plane H—H in FIG. 3.

The fourth alternative ignition means is illustrated in FIG. 12, which is a cross section taken on plane H—H in FIG. 3. A regular, stationary spark plug reaches each combustion chamber by penetrating the cylinder walls in cylinder blocks 10 and 11, in an angular, upward direction, from under the cylinder block attachment flange, and located closely in the nip of the adjacent cylinders. This location clears rotary disc valve outer seals by sufficient margin and utilizes the space available.

Figure 11:
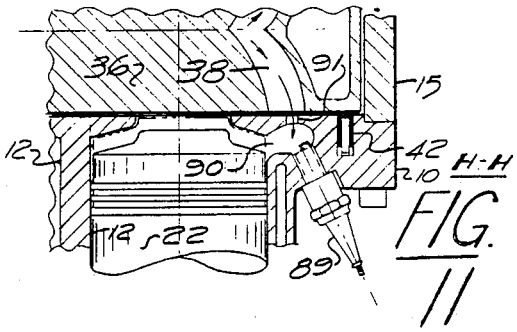
FIG. 11 is a cross section of one of the alternative ignition means and taken on plane H—H in FIG. 3.

The fifth alternative ignition means is illustrated In FIG. 11, which is a cross section taken on plane H—H in FIG. 3. A small pre-combustion chamber is incorporated in each cylinder block 10 and 11 and is located in the entrance of the nip formed by adjacent cylinders. In the nip area of the cylinders, the cylinder bores clear both rotary disc valve outer seal 42 and cylinder separation seal 43, by a wide margin and this margin is utilized. Inwardly the small precombustion chamber, designated as jet-ignition chamber 90, communicates with its associated combustion chamber, while upwardly said jet ignition chamber 90 communicates with the bottom surface of rotary disc valve 36, by means of a small hole, designated jet ignition chamber charging hole 91. As the high pressure charging port 38, sweeps across charging hole 91, at the extreme end of the exhaust stroke, a high pressure charge of fresh gas will rush into jet ignition chamber 90 and flush remaining exhaust gasses out of same. The action is illustrated in FIG. 3, which shows the path swept by high pressure charging port 38, and which illustrates the timing of port 38 relative to hole 91 and constricted cylinder bore port opening 83. Note that jet ignition chamber 90, hole 91 and the action of flushing said chamber 90 does not depend on the presence of constricted cylinder bore port opening 83 and that this action will be equally effective with constricted cylinder bore port opening 83 eliminated. This system is fully effective in Version I of this invention illustrated in FIG. 9. A conventional spark plug 89 reaches each jet ignition chamber 90.

The sixth alternative ignition means is identical in arrangement to the fifth alternative ignition means illustrated in FIG. 11, except that the flushing charge, which is delivered by high pressure charging port 38, is delivered by a separate rich mixture high pressure charging port hole. In this arrangement, constricted cylinder bore port opening 83, is reduced in area so that the extreme outward portion of cylinder bores 12 does not communicate with the high pressure charging port 38, while said charging port 38 is reduced in radial width. These modifications are illustrated in FIG. 3, Numeral 96 indicates the Rich mix constricted cylinder bore port opening; 97 indicates the Reduced high pressure rich mix charging port in rotary disc valve 36, while 98 indicates the Rich mix high pressure charging port hole in rotary disc valve 36. Port hole 98 communicates continuously inwardly, via a gallery in rotary disc valve 36, not shown, a small tubular gallery inside the hollow interior of hollow main shaft 17, not shown, and via a small concentric rotary pressure joint, not shown, with a small separate rich mix high pressure charger compressor, not shown. The rich mixture thus supplied to jet ignition chamber 90 is ignited by spark plug 89, and the jet of flame issuing from said chamber 90 ignites the lean mixture in the combustion chamber in each cylinder 12. Lean mixtures are used in certain instances to combat air pollution and improve fuel economy. In FIGS. 2, 7, 9, 10, Numeral 80 indicates the high pressure charging cycle, 81 indicates the power cycle, 82 indicates the positive total exhaust expulsion cycle, in which the power piston is driven upward to reduce the combustion chamber to practically zero volume.

Figure 5:
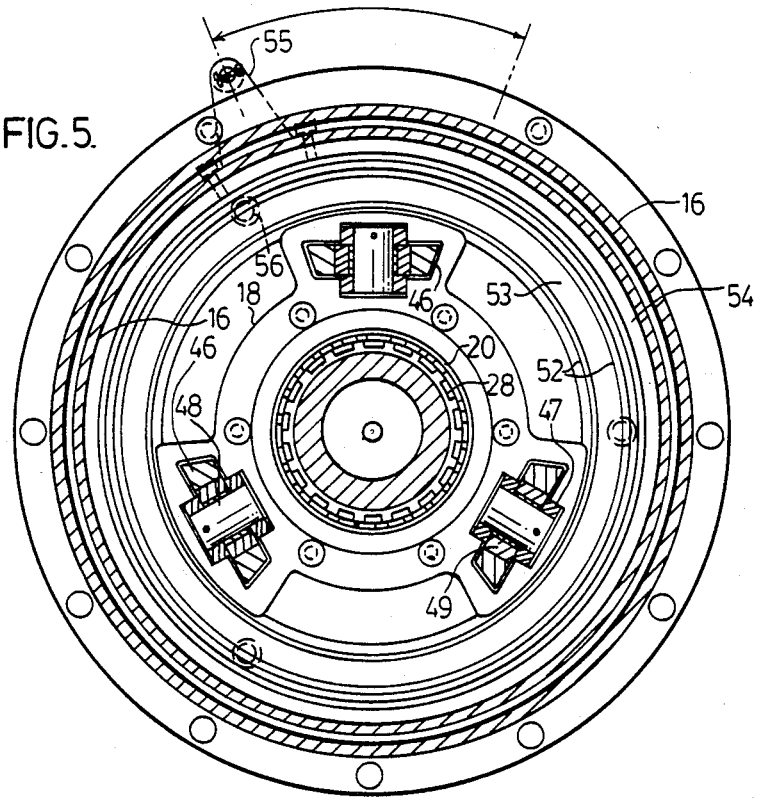
FIG. 5 is a transverse cross section of the engine showing the high pressure charger cylinder, high pressure charger piston rollers and taken on plane D—D in FIG. 1.
Figure 8:
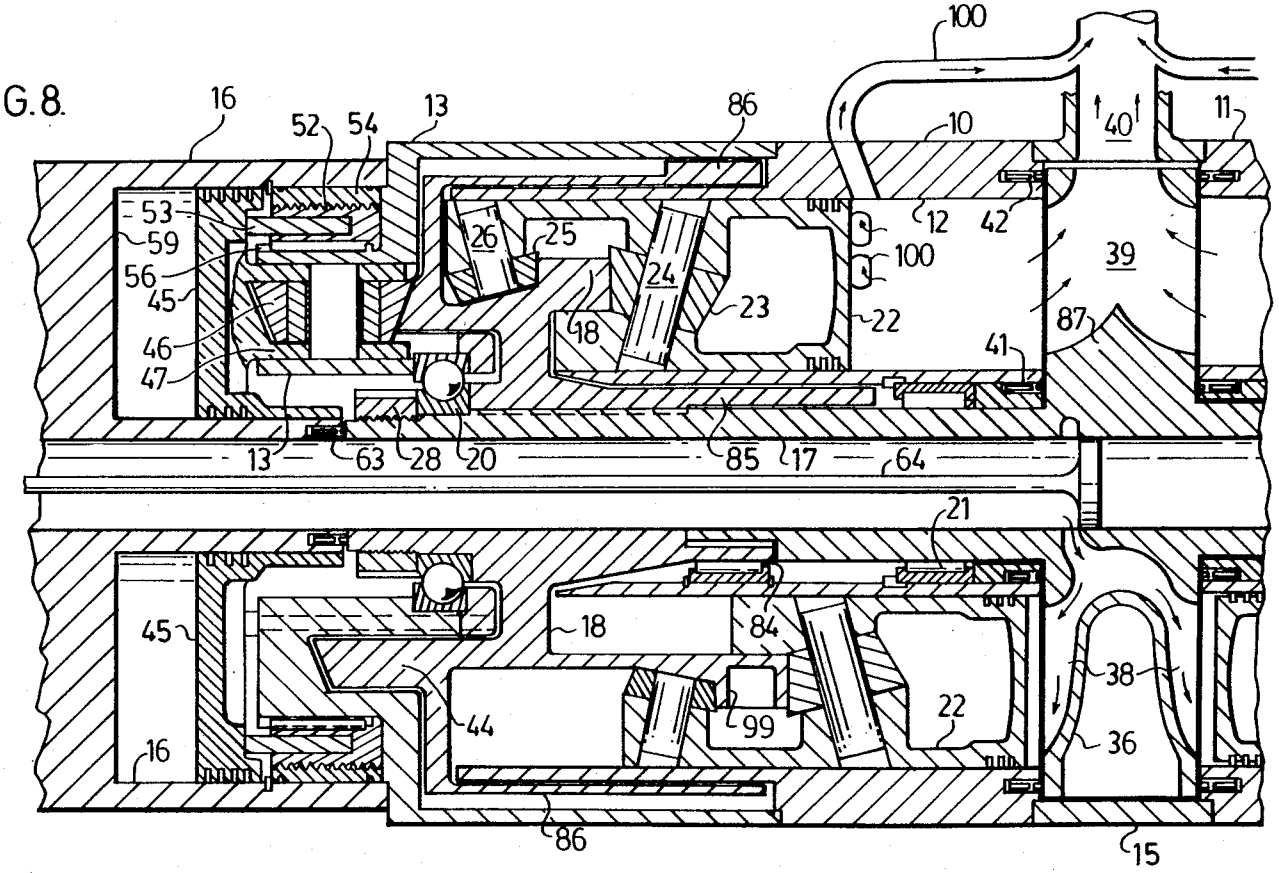
FIG. 8 is a longitudinal cross section of the preferred embodiment of the invention designated as Version 1, showing the pertinent parts of the axial pistons, axial cam driven engine, showing the high pressure charging port, the exhaust port, axial cam counterbalancing means, the high pressure charger, and taken on plane G—G in FIG. 9.
Figure 14:
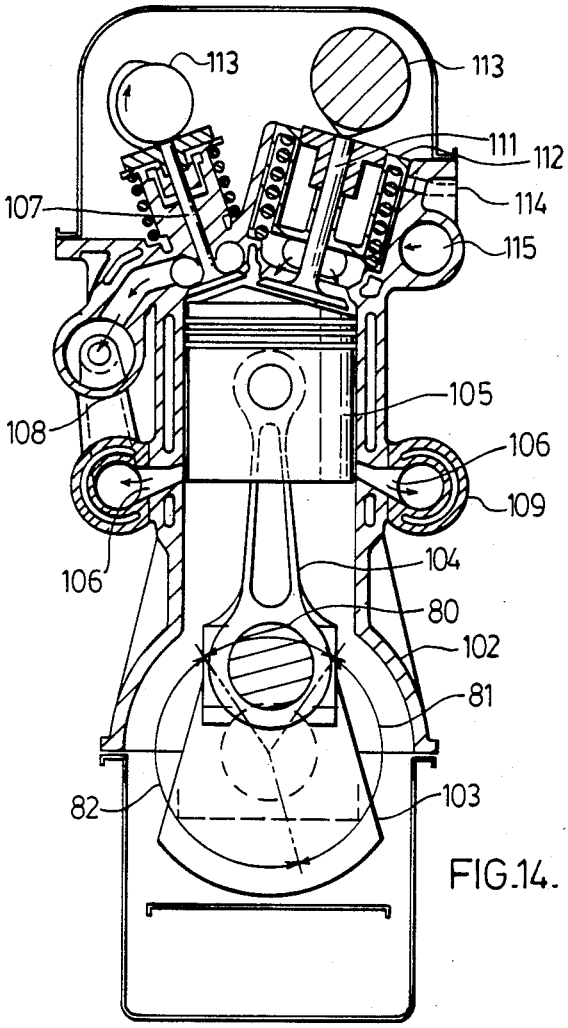
FIG. 14 is a transverse cross section of a conventional overhead valve engine executed to operate on the three cycle concept of this invention.
Figure 15:
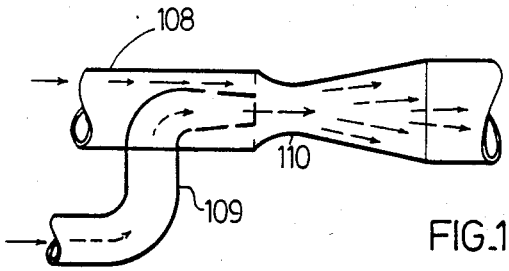
FIG. 15 is a longitudinal cross section of the venturi jet assisted exhaust extractor as per this invention.

FIG. 8 illustrates one half of Version I, with the remaining components identical to the components shown in FIG. 1. The difference between Version I, as illustrated in FIG. 8, and Version II, as illustrated in FIG. 1, is, as previously stated, the number of power strokes per piston per engine revolution. Version I indicates one powerstroke per piston per engine revolution while Version II indicates two power strokes per piston per engine revolution, Version III indicates three power strokes etc. Version I has an axial cam profile which is statically and dynamically out of balance. The imbalance is reduced by large balance indentations 99 in the outward cylindrical surface of the profile flange, as shown in FIG. 8 and FIG. 10. Counterbalancing measures may be carried out by an extra and integral cam counter balance weight 87, in rotary disc valve 36, or by extra metal installed on an extension of the hubs of axial cams 18 and 19, indicated as 85 in FIG. 8, or finally by cam counterbalancer drums 86, which carry extra weight on their rims to counterbalance axial cams 18 and 19. FIG. 8 further illustrates alternative construction of axial cams 18 and 19, and hollow main shaft 17. The hubs of the axial cams 18 and 19, may be provided with an extra cam steady bearing 84, and be provided with an internal or external spline to connect to extremely short hollow main shafts 17, which are reduced in length to become short shaft-like extensions on rotary disc valve 36. FIG. 8 further illustrates an alternative axial locator 56, for high pressure charger piston bottom stopper 52. Axial locator 56 is here in the form of matching and mating axial splines 56, which connect bottom stopper 52 to the intake side end cover 13. The three high pressure charger piston rollers 46, provide three point support for high pressure charger piston 45, and there is ample room to make said piston rollers 46, really wide and large for heavy duty service. Piston rollers 46 are tapered conical rollers, with the apex of the cone located on the long axis of the engine. This prevents the constant skewing encountered by cylindrical rollers normally employed on axially profiled cams, and this improvement significantly improves longevity and reduces friction and heat build-up. The reason is that the outside edge of the top surface of the profile on the axial high pressure charger cam 44 is much longer in circumference than the inside edge. High pressure charger piston is prevented from rotating in its cylinder bore by the high pressure charger piston legs, which engage closely matching slots in the intake side end cover 13, and which is clearly illustrated in FIGS. 5, 7, 10. FIGS. 1 and 8 also illustrates optional auxiliary exhaust ports 100 which further improves engine efficiency. A great number of alternative engine configurations may employ the inventive concepts. Any cam driven piston engine, whether of the axial cam or radial cam variety, can be executed to set up the proper sequence of conditions required for the successful employment of the inventive concepts. While many crank driven engines may employ same. The first requirement is a thorough means of expelling the hot exhaust gasses. The high pressure charge is extremely explosive. Deep expansion, the result of a limited fresh gas charge intake relative to the length of the power stroke, results in cool spent gasses, so deep expansion and a limited fresh gas charge intake set up ideal conditions for the three cycle concept disclosed. Super charging nearly always results in a hotter, higher pressure expanding gas charge and super charged engines thus may require air flushing during the exhaust stroke. Positive total exhaust expulsion, plus deep expansion, sets up ideal conditions. The valving means must have sharp cut-off times. The piston must be retained in the proper top position sufficiently long enough. Ideally the high pressure fresh gas charge is laid on top of the piston in a sweeping lateral motion. The rotary disc valve disclosed therefore is ideal for this purpose. Engines may have flat large auxiliary exhaust ports 360 degrees or less, in circumference at the bottom of the cylinder, numeral 100 in FIG. 8, which would discharge the bulk of the spent exhaust gasses. The kinetic energy of the spent gas molecules all rushing downward with the piston together with the remaining residual exhaust gas pressure would expel the bulk of the exhaust gas—these auxiliary exhaust ports would not rob power since they are very low in height and they must not be confused with regular exhaust ports in two cycle engines. These auxiliary exhaust ports greatly improve engine efficiency for this reason: there is considerable kinetic energy in the expanding gas mass with all molecules moving downward with the piston. The only molecules which are static are those in contact with the roof of the cylinder head, the rest all rush down at varying velocities, the closer to the top of the piston the greater the velocity. In conventional four cycle practice these downward rushing gasses are stopped dead and are reversed in travel direction during the subsequent piston upstroke. Auxiliary ports 100, allow these downward rushing gasses to escape laterally sideways, in 360 degree direction preferably and considerably lessens the work absorbed by the piston during the upstroke. The three cycle concept as disclosed may advantageously use auxiliary exhaust ports, 100, while cam driven four cycle engines with a shallow intake stroke may also advantageously utilize said improvement, still maintaining the regular four cycle principle. In addition, regular crank driven four cycle engines and all supercharged engines may more readily be converted to the three cycle concept disclosed by utilizing these auxiliary exhaust ports disclosed since they convey away the bulk of the spent exhaust gas and immediately drop the temperature of the remaining exhaust gas following known physical laws. The subsequent exhaust expelling upstroke can thus readily dispose of the remaining spent gasses, so that high pressure fresh charge induction can be successfully carried out with the piston in the top position, without excessive heat or quantity of remnant exhaust gasses. Fuel injection may also be carried out into the end of the hollow main shaft 17, after the intake air is pre-compressed, which method offers some advantages. Referring to FIGS. 14 and 15, there is shown a conventional crank driven piston engine, 102, converted to three cycle operation as per this invention. A high pressure positive displacement charge pre-compressor, not shown, of the piston, rotary screw or diaphragm type, either single stage or double stage, or double stage combination, is driven by the crank shaft 103 and pre-compresses the charge to a range from approximately 30 lbs. p.s.i. or less to a maximum of approximately 200 lbs. p.s.i. The volume of the charge pre-compressed may be regulated by varying the speed of the pre-compressor using an infinitely variable speed reducer, by varying the stroke of the pre-compressor, by internally recirculating some of the uncompressed charge, or by throttling the compressor air or charge intake. The pre-compressed charge is delivered to high pressure charge intake manifold 115. A conventional crankshaft, 103, reciprocates piston 105, by means of connecting rod, 104. Auxiliary exhaust ports 106, preferably arranged all around the cylinder bore for maximum efficiency, allows the bulk of the exhaust gasses to escape, yet these ports 106 do not interfere with power production since they are located near the very bottom of the stroke, where crank leverage is negligible. The main exhaust valve 107, is conventional and may be very small since the bulk of the exhaust gasses have been evacuated by ports 106. The piston drives out the remaining exhaust gasses during the upstroke, and exhaust gas evacuation may be greatly assisted by venturi jet assisted exhaust gas extractor 110, which utilizes the kinetic energy from the exhaust gas escaping from ports 106. Just before or at top dead center the main exhaust valve 107 closes and intake valve 111 opens, admitting a high pressure charge into the combustion chamber. The piston top dead center position is such that the combustion chamber is reduced to minimum possible volume—the top of the piston is provided with clearance cut outs to clear the valve heads. Main exhaust manifold 108 may be provided with venturi jet exhaust assist 110. The intake valve should be very fast acting, and may therefore be equipped with extra strong valve springs and may be assisted in the closing position by the high pressure of the charge. Inverted bucket valve guide 112 acts as an air cylinder, assisting the valve spring in closing intake valve 111 rapidly and positively. Both exhaust valve 107 and intake valve 111, may have threaded stems, as shown, with inverted bucket valve guides for both valves having matching threads. The bucket caps also are threaded onto the valve stems, and the combination of the three components, may be utilized to adjust the tappet clearance, with the bucket caps acting as the locknuts. Camshafts 113 run at the same speed as the crankshaft 103, and the lobes are designed for quick action. Suction gallery 114 connects to the intake of the high pressure pre-compressor to eliminate any loss of charge around valve guide bucket 112. Power output of the engine is controlled by the pressure of the pre-compressed charge; since the geometric volume of the combustion chamber and valve timing is constant; the pressure will determine the weight of the charge admitted, assuming that temperature and gas velocity do not affect the weight significantly at normal speeds. While reference has been made to only a single cylinder engine, it is to be understood that the concepts disclosed may be readily applied to most piston type engines. Therefore it is intended that the invention not be limited to the embodiments disclosed, but only by the language of the following claims.

The following areas of the invention are of particular interest:

a. Backfire protection. Backfire relief valves may be installed in the high pressure charging port area and in the high pressure charger valve head.

b. High pressure charge loss prevention. Loss of some of the high pressure charge may be prevented by returning any escaping gasses to the high pressure charger inlet duct. For this reason, the high pressure charger spool valve rotary gland is vented back to the said inlet duct. Positive "crankcase", cam case, ventilation will return any high pressure charge gasses escaping past the high pressure charger bottom seal to the said inlet duct. The final possible area of loss is the high pressure charging port itself. Careful design will prevent loss here by directing all outflowing gasses to the combustion chamber to be charged. Cylinder separation seals 43 may be advantageously located near the trailing edge of the constricted cylinder bore port opening, shown as location 43-a on drawing FIG. 3. In any case, the great separation between the trailing edge of the exhaust port and the leading edge of the high pressure charging port plus the fact that the piston is in the extreme top position when high pressure charging commences, prevents communication between these ports during the high pressure charging cycle.

c. Adequacy of high pressure charge delivery to each combustion chamber. Since the gas charge is pre-compressed in a relatively cool chamber free from hot spots, the charge can be denser and although the time available for charging is small, the high speed "laying" action of the high pressure charging ports with sharp cut off times will ensure good charging. For Version I, with one piston power stroke per piston per revolution, the charging time available is extremely generous. For Version II, with two power strokes per piston per revolution, the illustrated high pressure charging cycle in FIGS. 2 and 7 is 30 degrees or seventeen percent of the complete cycle, with the power stroke being $76\frac{1}{2}$ degrees or $42\frac{1}{2}$% and the exhaust stroke being $72\frac{3}{4}$ degrees or $40\frac{1}{2}$%. This applies to $3\frac{1}{4}''$ bore cylinders spaced at 60 degrees on a $7\frac{1}{2}''$ diameter cylinder circle.

d. Engine vibration due to high pressure charger piston inertia. This inertia is very small compared to total inertia of engine and the direction is directly through the centre of gravity of the engine.

e. A great amount of variation is possible in the area of port timing, number of cylinders and number of cam lobes. For example, by going to an $8\frac{5}{8}''$ diameter cylinder circle, the constricted bore port opening may be eliminated and a fully open bore, the same as Version I may be used for Version II. The number of cylinders may be increased to 7 per bank. The high pressure charging cycle in this instance may be 50 degress or 28%, the power cycle $66\frac{1}{2}$ degrees or 37% and the exhaust cycle $63\frac{1}{2}$ degrees or 35%. The greater high pressure charging cycle would improve the available time for lowering the piston to make room for more high pressure charge induction. This Version would be Version 2-a.

On the basis of the foregoing example, Version III with three power strokes per piston per revolution would have a cylinder circle of $12\frac{7}{8}''$ diameter. The following chart summarizes a possible series of combinations, all based on a $3\frac{1}{4}''$ bore, a $3\frac{1}{2}''$ stroke, a $13\frac{1}{2}''$ lobe separation on the axial cam, with a port timing or per above Version 2-a. Bores could be wide open at the top, except on Version 2.

| Version Number | Cylinder Circle Diameter | Power Strokes per piston per revolution | Number of cylinders | Power Impulses per revolution* Gross | Actual |
|---|---|---|---|---|---|
| 1 | $7\frac{1}{2}$ | 1 | 6 | 3 | 3 |
| 2 | $7\frac{1}{2}$ | 2 | 6 | 3 | 3 |
| 2-a | $8\frac{5}{8}$ | 2 | 7 | 3.5 | 7 |
| 3 | $12\frac{7}{8}$ | 3 | 10 | 3.3 | 10 |
| 4 | $17\frac{1}{8}$ | 4 | 14 | 3.5 | 14 |
| 5 | $21\frac{1}{2}$ | 5 | 17 | 3.4 | 17 |
| 6 | $25\frac{3}{4}$ | 6 | 21 | 3.5 | 21 |
| 7 | 30 | 7 | 24 | 3.4 | 24 |
| 8 | $34\frac{3}{8}$ | 8 | 28 | 3.5 | 28 |

| Version Number | Revolutions based on identical piston speeds | Lobe Separation Degrees | Cylinder Separation Degrees |
|---|---|---|---|
| 1 | 1 | 360 | 60 |
| 2 | .5 | 180 | 60 |
| 2-a | .5 | 180 | 51.50 |
| 3 | .17 | 120 | 36 |
| 4 | .125 | 90 | 25.7 |
| 5 | .1 | 72 | 21.17 |
| 6 | .085 | 60 | 17.14 |
| 7 | .07 | 51.50 | 15 |
| 8 | .062 | 45 | 12.85 |

*Since the angular separation between the cam lobes and the cylinder centers does not need to coincide, the actual ignition of cylinders does not need to be simultaneous for any pair or multiple, resulting in smoother power output. Cam profiles may be designed to lower the piston rapidly during the initial phase of the high pressure charging cycle, and maintaining the piston at the correct position for completion of the high pressure charging cycle. This would place a greater stress on components but would improve high pressure charge induction.

f. Piston speeds, output revolutions, balance and component stresses. Piston pseeds would be a more useful criteria than output speeds. For identical piston speeds, the output speed for Version I would be 1, etc. as shown in the chart. Reduced output speeds with an increased number of power pulses per revolution may be an advantage in some applications.

Simultaneous ignition of cylinders located diametrically opposite, results in perfect cancellation of bending stresses in the axial cam and hollow main shaft, and theoretically therefore reduces the bearing loads to nil also. This would greatly benefit longevity and Version II takes advantage of this. However, a detriment is that power impulses are in step and therefore less overlapping.

g. High pressure charger. The energy absorbed by the high pressure charger, under average conditions, is less than the energy normally required for taking in and compressing the required fresh gas charge for these reasons 1. The high pressure charger piston sliding contact area is less than one third of the contact area of the power pistons for equal geometric volume.
2. The high pressure charger piston displaces only the actual amount of gas charge required for engine power, as opposed to the great amount of waste motion for constant stroking power pistons.
3. The high pressure charger piston does not work against a strong vacuum, as is common in intake manifolds.
4. The total reciprocating mass for the high pressure charger piston is less than one-third the total mass of the power pistons.
5. High pressure charger piston ring line contact is less than one-third the line contact of the power piston piston rings.

h. The object of the invention is a more fuel efficient piston type internal combustion engine and the intention is to achieve this object along two avenues: lighter weight, or, in other words, higher specific output, while at the same time improving fuel economy. These engines basically fall into two use categories, constant power output and variable power output. Constant power output engines are basically used in ships, planes, trains, stationary plants, and to some extent large earthmoving equipment and large trucks. Variable power output engines are basically used in small public transportation vehicles and private vehicles. It is known that for maximum fuel efficiency, every aspect of the engine, all the features of its construction including its relative weight, and its ultimate use, must be optimized. This includes elimination or reduction of all power losses within and outside the engine such as windage losses, pumping losses, friction losses, heat energy losses from the engine and from the exhaust, and improving combustion efficiency. Foremost amongst these considerations is the optimizing of the combustion cycle. Some of the known conditions which lead to an optimum combustion cycle are as follows: a thoroughly atomized, well proportioned, well mixed fuel charge, uncontaminated by exhaust gas remnants, preheated to optimum value, compressed to maximum permissible value, provided with strong central ignition in a combustion chamber which approaches the spherical shape in configuration, with insulated walls to reduce heat losses, and expanded to maximum practical potential. These conditions can more easily be met in a constant power output engine than in a variable output engine; some of the known reasons for this are the following: the shape, the temperature and the timing of gas charge intake systems work under fixed conditions and can be optimized in relation to the dynamic characteristic of the incoming gas charge, and the geometric compression ratio can be made equal to the optimum gas compression ratio, since the weight of the gas charge is constant for each combustion cycle. The latter situation especially is a problem for variable power output engines. The geometric ratio must equal the maximum permissible compression ratio for the maximum weight of the gas charge taken in for each cycle. However, very seldom are these engines used with a maximum weight of gas charge intake per cycle. Probably 75% of the actual operating time, only approximately 50% of the maximum possible gas charge weight per cycle is taken in. Therefore, unless automatically variable geometric compression ratio adjustment is provided, which is the object of a separate patent application by the inventor, the next alternative is to provide a maximum geometric compression ratio for this 50% of the maximum possible gas charge weight per cycle, in other words, limit the fresh gas charge intake to 50% of what is geometrically possible and provide a full maximum permissible gas compression ratio for this limited gas charge intake. Thus the intake stroke is limited to 50% of the geometric cylinder volume, or the intake stroke is shallow. This has the additional and extremely important known side benefits of a deep expansion power stroke, which utilizes close to 100% of the geometric cylinder volume and thus utilizes some of the energy in the exhaust gas otherwise wasted; plus results in lower average combustion temperatures enhancing nitrous oxides emission problems, although deteriorating hydro carbon emission problems; plus results in a cooler, quieter exhaust requiring less muffling. The deteriorating hydro carbon emission problem may be partially remedied by a lean mixture. Reducing the intake charge to 50% of that which is the maximum geometrically possible, would normally result in a lack of power in high power demand situations, but this loss of maximum potential power is offset to a large degree by the power gained from the extra deep expansion stroke, which is known to utilize a substantial amount of the energy otherwise wasted in the exhaust gas. Extra gear ratios in the transmission of road vehicles would take care of extra high power demand situations. Basically, what has been arrived at so far is an engine which is optimized for average power demand in variable power demand applications such as in provide road vehicles, while the deep expansion power stroke also benefits constant power output applications. This invention provides a means for obtaining a limited weight for the intake charge, relative to the geometric volume of the cylinders. The intake charge, in this invention, is determined by a variable displacement gas charge pre-compressor, and the displacement may be readily limited to 50% of the maximum geometric displacement of the power pistons in the combustion cylinders, so that the full benefits of deep expansion and maximum gas compression ratio may be obtained at maximum power. For this invention any practical ratio of gas charge intake volume relative to power cylinder geometric displacement may be obtained; the geometric ratio in the power cylinder must be adjusted to suit; thus a supercharger effect may be obtained if desired for certain applications. Volumetric displacement variation may be obtained by manipulating with the intake valves in normal engines but this procedure wastes energy in gas pumping losses, wasted reciprocating motion and wasted rotary motion. One of the objects of this invention is to reduce or eliminate throttling losses, pumping losses and wasted reciprocating motion losses, and to this intent the intake and compression chores have been divorced from the power cylinders; only the actual displacement is used which is required to take in the actual gas charge required at any particular time, and to take in this required gas charge without the wasted energy associated with throttling; and to pre-compress this required gas charge to the same gas compression ratio which would normally be achieved in the combustion chamber of a normally aspirated, normally throttled engine. The degree of pre-compression in the economy mode of this invention is automatically governed by two factors:

a. the actual geometric volume of the combustion chamber when the high pressure charging port closes; this is consistent.

b. The power demand on the engine.

The said geometric volume is chosen to accommodate the weight of the gas charge required for maximum pre-determined power with said gas charge compressed to maximum permissible value, and the maximum output of the pre-compressor must be capable of meeting this demand. The power developed for each combustion equals the power demand. The power developed basically is determined by two factors, all else being equal; the weight of the gas charge and the volume of the chamber. Thus the amount of pre-compression determines the weight of the gas charge admitted. Therefore the degree of pre-compression automatically follows the power demand. In this respect this invention is no better nor worse than conventional practice; the actual charge, when it is ignited, is only compressed to maximum permissible value at maximum power. Similarly, the burning gasses, are only expanded to optimum low pressure levels at a certain weight of charge intake; the porting of auxiliary exhaust ports 100 and the main exhaust valve timing would probably, and should, be arranged to be most effective close to maximum power. However, since this invention is intended to provide greater efficiency in the upper power delivery range, being the most used range in future private vehicles, no great detriment is seen here.

The one piece pistons 22 having a great height, may be provided with separate insulated crowns to avoid heat distortion of the skirts, said insulated crowns may be cooled by a jet of lube oil directed from below. Said one piece pistons 22 may be provided with flanged conical main cam rollers 23, installed square with the long axis of the engine, said flange being a spherically radiused radial flange and arranged on the large outside diameter of the main cam roller, with the top outside edge of the profile on axial cams 18 and 19 having a matching radiused notch, said radial flange preventing the side thrust, which is the result of the inclined contact line, from reacting against the outward cylinder walls, Crank driven piston engine 102 may be provided with any kind of valving means, the valving requirements being an exhaust valve means capable of communication with the atmosphere during the exhaust upstroke of the piston, and closing sharply with the piston in the top portion of the stroke; a high press charge intake valve means, capable of admitting the high pressure charge with the piston in the top portion of the stroke and closing sharply upon completion of the high pressure charging cycle. Ignition for crank driven engine 102 may be any established kind, and preferably provided with a means to prevent ignition with the high pressure charge intake valve means open. All references applicable to crank driven engines are equally applicable to radial cam driven engines. The charge high pressure pre-compressor may be of any positive displacement type capable of sustaining 125 to 200 lbs. p.s.i. and capable of variable output by means previously disclosed. Types being piston type, rotary type or diaphragm type, and two stage combinations may be effectively employed.

It is known that cam or wobble plate driven axial piston motors and engines may be executed in inwardly opposing or outwardly opposing versions. By splitting the preferred embodiment in FIG. 1 on the radial centerplane, inversing both halves and re-assembling same, an outwardly opposed alternative engine is arrived at. The rotary disc valve halves thus obtained would require closing the outward facing opening of the high pressure charging port and the rotary disc valve housing halves similarly would require an end wall on the outward ends. The hollow main shaft would extend outwardly with the charge high pressure pre-compressor mounted on outward end of the newly arrived at engine. Similarly, one of the newly arrived at engine halves may operate as a single cylinder block, especially in Version 2, which gives three power pulses which could counterbalance the three compression strokes of the compressor, to improve the balance of the single block engine.

A charge high pressure pre-compression means may be disposed on each end of the engine of the preferred embodiment in FIG. 1 giving better balance and allowing a much smaller compressor since the duty is shared between two. While the invention has been disclosed by reference to specific preferred embodiments, it should be understood that numerous alternative engine configurations may utilize the inventive concepts disclosed and that numerous changes could be made within the scope of the invention concepts disclosed. Accordingly, the invention is not intended to be limited by the disclosure, but rather to have the full scope permitted by the language of the following claims.

The embodiments of the invention in which an exclusive property or privilege is claimed are defined as follows:

1. An axial cam driven, axially opposed piston type internal combustion engine comprising in combination two symmetrical but opposite and opposing cylinder blocks defining a first cylinder block and a second cylinder block, each cylinder block defining axially disposed cylinders arranged in parallel, annularly and symmetrically spaced about a common long axis, all cylinders of each block terminating at a flat plane which is square with said long axis and the cylinders of the cylinder blocks being axially aligned with a cylinder of the opposed cylinder block and separated therefrom by a short distance, an axially disposed main shaft, concentric with said long axis, said main shaft axially and radially supported by main bearings axially and concentrically arranged in said cylinder blocks on said long axis, said main shaft having a hollow portion which functions as a high pressure charge distribution means, said hollow portion being disposed in said first cylinder block, a piston in each of said cylinders disposed to form opposing piston pairs, an axially profiled first axial cam and an axially profiled second axial cam, said first axial cam mounted securely and concentrically on an outward portion of said hollow portion of said main shaft and operatively connected to said pistons in said first cylinder block, said second axial cam mounted securely on an outward portion of said main shaft in said second cylinder block and operatively connect to said pistons in said second cylinder block, said axial cams cooperating with said pistons to convert any reciprocating motion of said pistons to rotational motion of said main shaft, said first axial cam and said second axial cam being symmetrically opposed to impart opposed reciprocating motion to said piston pairs, a rotary disc valve housing defining a cylindrical housing spanning between said cylinder blocks and forming a rigid structural connection between said cylinder blocks, said rotary disc valve housing including at least one exhaust duct communicating between said housing and surrounding atmosphere, each of said pistons being movable within one of said cylinders from a top center portion adjacent said rotary disc valve housing to a bottom center position, a valving means, defining a rotary disc valve comprising a thick flat, circular disc, concentrically and securely mounted on said main shaft between said piston pairs, said disc valve having a thickness closely matching said short distance between said opposing cylinder blocks, said disc valve having a diameter large enough to completely cover said cylinders thereby forming individual combustion chambers therein, said rotary disc valve further including an exhaust port defining a radial opening spanning through the thickness of said disc valve and communicating continuously radially outwardly with said rotry disc valve housing and said atmosphere, said exhaust port being of such annular extent as to be brought into axial alignment with said cylinders during movement from said bottom center position to said top center position of said pistons, said rotary disc valve further including a high pressure charging port defined by a radial opening spanning through the thickness of said disc valve and communicating continuously radially inwardly with said hollow portion of said main shaft, said high pressure charging port being of such annular extent so as to be brought into axial alignment with said cylinders only while said pistons are in the top center position in said cylinders, said high pressure charging port forming a terminating portion of said high pressure charge distribution means, a gas charge high pressure pre-combustion means, defining a reciprocating piston compressor means for compressing a gas charge to a precombustion pressure, disposed at an end of said first cylinder block, said piston compressor means operatively connected to and driven by said main shaft, said piston compressor means communicating with said hollow portion of said main shaft via a compressor outlet valving means and communicating with a gas charge intake means via a compressor inlet valving means, said gas charge intake means, defining a means to pre-condition the gas charge including fuel and air mixing means, an ignition means, defining a means of sequentially igniting the high pressure gas charge in successive ones of said combustion chamber after said high pressure charging port has sequentially been brought out of alignment with successive ones of said combustion chambers;

each combustion chamber is sealed by a first sealing element in the form of a rotary disc valve inner seal, a second sealing element in the form of a rotary disc valve outer seal, and a third sealing elements in the form of cylinder separation seals, said first sealing element defining a first annular ring of cylindrical shape and disposed in a first annular groove concentrically arranged in said cylinder block, said annular ring being biased axially towards and bearing against a flat surface of said rotary disc valve; said second sealing element defining a second annular ring, cylindrically shaped, and disposed in a second annular groove, concentrically arranged in said cylinder block, said second annular ring being biased axially towards and bearing against a flat surface of said rotary disc valve; said third sealing elements defining straight bars, rectangular in sectional outline, and disposed in straight grooves, radially arranged in each cylinder block between said cylinders and spanning from said first annular groove to said second annular groove, said third sealing elements being biased axially towards, and bearing against, a flat surface of said rotary disc valve;

said first cylinder block and said second cylinder block are provided with straight, smooth bored holes to contain said main shaft, and wherein said first sealing element has an outside diameter equal to the inside diameter of said smooth bored holes, said first sealing element being disposed in a separate annular ring, L-shaped in cross section, with an outside diameter equal to an inside diameter of said smooth bored holes.

2. An axial cam driven, axially opposed piston type internal combustion engine comprising in combination two symmetrical but opposite and opposing cylinder blocks defining a first cylinder block and a second cylinder block, each cylinder block defining axially disposed cylinders arranged in parallel, annularly and symmetrically spaced about a common long axis, all cylinders of each block terminating at a flat plane which is square with said long axis and the cylinders of the cylinder blocks being axially aligned with a cylinder of the opposed cylinder block and separated therefrom by a short distance, an axially disposed main shaft, concentric with said long axis, said main shaft axially and radially supported by main bearings axially and concentrically arranged in said cylinder blocks on said long axis, said main shaft having a hollow portion which functions as a high pressure charge distribution means, said hollow portion being disposed in said first cylinder block, a piston in each of said cylinders disposed to form opposing piston pairs, an axially profiled first axial cam and an axially profiled second axial cam, said first axial cam mounted securely and concentrically on an outward portion of said hollow portion of said main shaft and operatively connected to said pistons in said first cylinder block, said second axial cam mounted securely on an outward portion of said main shaft in said second cylinder block and operatively connect to said pistons in said second cylinder block, said axial cams cooperating with said pistons to convert any reciprocating motion of said pistons to rotational motion of said main shaft, said first axial cam and said second axial cam being symmetrically opposed to impart opposed reciprocating motion to said piston pairs, a rotary disc valve housing defining a cylindrical housing spanning between said cylinder blocks and forming a rigid structural connection between said cylinder blocks, said rotary disc valve housing including at least one exhaust duct communicating between said housing and surrounding atmosphere, each of said pistons being movable within one of said cylinders from a top center position adjacent said rotary disc valve housing to a bottom center position, a valving means, defining a rotary disc valve comprising a thick flat, circular disc, concentrically and securely mounted on said main shaft between said piston pairs, said disc valve having a thickness closely matching said short distance between said opposing cylinder blocks, said disc valve having a diameter large enough to completely cover said cylinders thereby forming individual combustion chambers therein, said rotary disc valve further including an exhaust port defining a radial opening spanning through the thickness of said disc valve and communicating continuously radially outwardly with said rotary disc valve housing and said atmosphere, said exhaust port being of such annular extent as to be brought into axial alignment with said cylinders during movement from said bottom center position to said top center position of said pistons, said rotary disc valve further including a high pressure charging port defined by a radial opening spanning through the thickness of said disc valve and communicating continuously radially inwardly with said hollow portion of said main shaft, said high pressure charging port being of such annular extent so as to be brought into axial alignment with said cylinders only while said pistons are in the top center position in said cylinders, said high pressure charging port forming a terminating portion of said high pressure charge distribution means, a gas charge high pressure pre-combustion means, defining a reciprocating piston compressor means for compressing a gas charge to a precombustion pressure, disposed at an end of said first cylinder block, said piston compressor means operatively connected to and driven by said main shaft, said piston compressor means communicating with said hollow portion of said main shaft via a compressor outlet valving means and communicating with a gas charge intake means via a compressor inlet valving means, said gas charge intake means, defining a means to pre-condition the gas charge including fuel and air mixing means, an ignition means, defining a means of sequentially igniting the high pressure gas charge in successive ones of said combustion chambers after said high pressure charging port has sequentially been brought out of alignment with successive ones of said combustion chambers;

said reciprocating piston compressor means comprising an axially and concentrically disposed piston compressor, axially and concentrically disposed on an end of said first cylinder block, said compressor being operatively connected to said main shaft by means of an axially profiled high pressure charger cam, and including an annular ring shape compressor piston disposed around a static cylindrical concentric hollow center column which is concentrically disposed about the long axis of the engine and about one end of said main shaft, said compressor piston being provided with piston rollers engageable with said high pressure charger cam in a manner which will convert rotary motion of said high pressure charger cam to reciprocating motion of said compressor piston, said high pressure charger cam being concentrically mounted on said main shaft;

said hollow center column being arranged to axially meet said hollow portion of said main shaft and wherein said hollow center column forms a portion of said high pressure charge distribution means;

said compressor piston having movement thereof partially determined by high pressure charger top bumpers, said top bumpers defining a non-metal elasatic bumper means comprising cylindrical metal enclosed, elastomer containing, cartridges, provided with threaded stem like extensions which extend through said piston compressor for purposes of providing an externally accessible adjusting means.

3. An axial cam driven, axially opposed piston type internal combustion engine comprising in combination two symmetrical but opposite and opposing cylinder blocks defining a first cylinder block and a second cylinder block, each cylinder block defining axially disposed cylinders arranged in parallel, annularly and symmetrically spaced about a common long axis, all cylinders of each block terminating at a flat plane which is square with said long axis and the cylinders of the cylinder blocks being axially aligned with a cylinder of the opposed cylinder block and separated therefrom by a short distance, an axially disposed main shaft, concentric with said long axis, said main shaft axially and radially supported by main bearings axially and concentrically arranged in said cylinder blocks on said long axis, said main shaft having a hollow portion which functions as a high pressure charge distribution means, said hollow portion being disposed in said first cylinder block, a piston in each of said cylinders disposed to form opposing piston pairs, an axially profiled first axial cam and an axially profiled second axial cam, said first axial cam mounted securely and concentrically on an outward portion of said hollow portion of said main shaft and operatively connected to said pistons in said first cylinder block, said second axial cam mounted securely on an outward portion of said main shaft in said second cylinder block and operatively connect to said pistons in said second cylinder block, said axial cams cooperating with said pistons to convert any reciprocating motion of said pistons to rotational motion of said main shaft, said first axial cam and said second axial cam being symmetrically opposed to impart opposed reciprocating motion to said piston pairs, a rotary disc valve housing defining a cylindrical housing spanning between said cylinder blocks and forming a rigid structural connection between said cylinder blocks, said rotary disc valve housing including at least one exhaust duct communicating between said housing and surrounding atmosphere, each of said pistons being movable within one of said cylinders from a top center position adjacent said rotary disc valve housing to a bottom center position, a valving means, defining a rotary disc valve comprising a thick flat, circular disc, concentrically and securely mounted on said main shaft between said piston pairs, said disc valve having a thickness closely matching said short distance between said opposing cylinder blocks, said disc valve having a diameter large enough to completely cover said cylinders thereby forming individual combustion chambers therein, said rotary disc valve further including an exhaust port defining a radial opening spanning through the thickness of said disc valve and communicating continuously radially outwardly with said rotary disc valve housing and said atmosphere, said exhaust port being of such annular extent as to be brought into axial alignment with said cylinders during movement from said bottom center position to said top center position of said pistons, said rotary disc valve further including a high pressure charging port defined by a radial opening spanning through the thickness of said disc valve and communicating continuously radially inwardly with said hollow portion of said main shaft, said high pressure charging port being of such annular extent so as to be brought into axial alignment with said cylinders only while said pistons are in the top center position in said cylinders, said high pressure charging port forming a terminating portion of said high pressure charge distribution means, a gas charge high pressure pre-combustion means, defining a reciprocating piston compressor means for compressing a gas charge to a precombustion pressure, disposed at an end of said first cylinder block, said piston compressor means operatively connected to and driven by said main shaft, said piston compressor means communicating with said hollow portion of said main shaft via a compressor outlet valving means and communicating with a gas charge intake means via a compressor inlet valving means, said gas charge intake means, defining a means to pre-condition the gas charge including fuel and air mixing means, an ignition means, defining a means of sequentially igniting the high pressure gas charge in successive ones of said combustion chambers after said high pressure charging port has sequentially been brought out of alignment with successive ones of said combustion chambers;

said reciprocating piston compressor means comprising an axially and concentrically disposed piston compressor, axially and concentrically disposed on an end of said first cylinder block, said compressor being operatively connected to said main shaft by means of an axially profiled high pressure charger cam, and including an annular ring shape compressor piston disposed around a static cylindrical concentric hollow center column which is concentrically disposed about the long axis of the engine and about one end of said main shaft, said compressor piston being provided with piston rollers engageable with said high pressure charger cam in a manner which will convert rotary motion of said high pressure charger cam to reciprocating motion of said compressor piston, said high pressure charger cam being concentrically mounted on said main shaft;

said hollow center column being arranged to axially meet said hollow portion of said main shaft and wherein said hollow center column forms a portion of said high pressure charge distribution means;

and wherein travel of said compressor piston is limited by an adjustable, compressor piston bottom stopper means which controls volumetric displacement of said compressor;

said compressor piston bottom stopper means comprises an annular ring, provided with an annular ring shaped, elastomer bottom stopper insert, said insert intermittently and momentarily contacting said compressor piston to intercept a downward stroke thereof, said bottom stopper insert including external threads and means to prevent rotation of said bottom stopper insert and to permit axial movement only, said bottom stopper means further including a bottom stopper adjuster, defining a cylindrical ring, provided with internal threads, engageable with said bottom stopper insert, said cylindrical ring being disposed in a bottom portion of a cylinder of said compressor in a manner which will allow rotation, but which will prevent axial displacement, said bottom stopper adjuster further being provided with a means for rotating same, and to thereby control a level at which said bottom stopper means will intercept said compressor piston, whereby the output of said compressor is controlled.

4. An engine according to claim 3 wherein said means for rotating said bottom stopper adjuster comprises a bottom stopper adjuster control quadrant, defining an arm shaped lever, securely fastened to a cylindrical outside surface of said bottom stopper adjuster, said lever radially extending through a wall of said compressor cylinder to be engageable with external control means.

5. An axial cam driven, axially opposed piston type internal combustion engine comprising in combination two symmetrical but opposite and opposing cylinder blocks defining a first cylinder block and a second cylinder block, each cylinder block defining axially disposed cylinders arranged in parallel, annularly and symmetrically spaced about a common long axis, all cylinders of each block terminating at a flat plane which is square with said long axis and the cylinders of the cylinder blocks being axially aligned with a cylinder of the opposed cylinder block and separated therefrom by a short distance, an axially disposed main shaft, concentric with said long axis, said main shaft axially and radially supported by main bearings axially and concentrically arranged in said cylinder blocks on said long axis, said main shaft having a hollow portion which functions as a high pressure charge distribution means, said hollow portion being disposed in said first cylinder block, a piston in each of said cylinders disposed to form opposing piston pairs, an axially profiled first axial cam and an axially profiled second axial cam, said first axial cam mounted securely and concentrically on an outward portion of said hollow portion of said main shaft and operatively connected to said pistons in said first cylinder block, said second axial cam mounted securely on an outward portion of said main shaft in said second cylinder block and operatively connect to said pistons in said second cylinder block, said axial cams cooperating with said pistons to convert any reciprocating motion of said pistons to rotational motion of said main shaft, said first axial cam and said second axial cam being symmetrically opposed to impart opposed reciprocating motion to said piston pairs, a rotary disc valve housing defining a cylindrical housing spanning between said cylinder blocks and forming a rigid structural connection between said cylinder blocks, said rotary disc valve housing including at least one exhaust duct communicating between said housing and surrounding atmosphere, each of said pistons being movable within one of said cylinders from a top center position adjacent said rotary disc valve housing to a bottom center position, a valving means, defining a rotary disc valve comprising a thick flat, circular disc, concentrically and securely mounted on said main shaft between said piston pairs, said disc valve having a thickness closely matching said short distance between said opposing cylinder blocks, said disc valve having a diameter large enough to completely cover said cylinders thereby forming individual combustion chambers therein, said rotary disc valve further including an exhaust port defining a radial opening spanning through the thickness of said disc valve and communicating continuously radially outwardly with said rotary disc valve housing and said atmosphere, said exhaust port being of such annular extent as to be brought into axial alignment with said cylinders during movement from said bottom center position to said top center position of said pistons, said rotary disc valve further including a high pressure charging port defined by a radial opening spanning through the thickness of said disc valve and communicating continuously radially inwardly with said hollow portion of said main shaft, said high pressure charging port being of such annular extent so as to be brought into axial alignment with said cylinders only while said pistons are in the top center position in said cylinders, said high pressure charging port forming a terminating portion of said high pressure charge distribution means, a gas charge high pressure pre-combustion means, defining a reciprocating piston compressor means for compressing a gas charge to a precombustion pressure, disposed at an end of said first cylinder block, said piston compressor means operatively connected to and driven by said main shaft, said piston compressor means communicating with said hollow portion of said main shaft via a compressor outlet valving means and communicating with a gas charge intake means via a compressor inlet valving means, said gas charge intake means, defining a means to pre-condition the gas charge including fuel and air mixing means, an ignition means, defining a means of sequentially igniting the high pressure gas charge in successive ones of said combustion chambers after said high pressure charging port has sequentially been brought out of alignment with successive ones of said combustion chambers, whereby an inwardly opposed axial piston three cycle internal combustion engine is provided and the power output of all cylinders is controlled by a single compressor spool valve concentrically disposed in said rotary disc valve, said spool valve defining a thick disc like spool, concentrically and reciprocatably disposed within a compressor spool port which is located concentrically within said rotary disc valve, said spool valve being axially moveable relative to said rotary valve for controlling the flow of the high pressure gas charge into said high pressure charging port and hence into each of said combustion chambers, said spool valve further including a long stem, extending from said disc like spool outwardly within said hollow portion of said main shaft, to pass through an end wall of said engine, by means of a rotary gland, said stem providing the means to control the movement of said disc like spool.

6. An engine according to claim 5 wherein said rotary gland comprises a rotary gland cartridge comprising a hollow cylindrical housing with an inward turned radial flange on an inside end, said cartridge further comprising a cylindrical axial face seal carrier, and an axial face seal, both located within said hollow cylindrical housing, said face seal carrier defining a first small hollow cylinder having ends, with a slightly larger second hollow cylinder concentrically surrounding said first small hollow cylinder and with a radial flange located intermediate the ends of said first small hollow cylinder, connected to an outward end of said second hollow cylinder, and with said axial face seal reciprocatably disposed within an annular groove formed by an outside diameter of said first small hollow cylinder and an inside diameter of said second hollow cylinder, said axial face seal being biased against an internal face of said radial flange by a spring means, said cartridge further comprising a conventional deep groove ball bearing, concentrically disposed within an outward end of said cartridge to support said face seal carrier axially and radially but rotatably within said hollow cylindrical housing.

* * * * *